US008667741B1

(12) United States Patent
Warner et al.

(10) Patent No.: US 8,667,741 B1
(45) Date of Patent: Mar. 11, 2014

(54) KIT FOR ASSEMBLING A BUILDING STRUCTURE RESISTANT TO OVERHEAD ORDINANCE DETONATIONS

(71) Applicant: Dynamic Air Shelters Ltd., Calgary (CA)

(72) Inventors: Harold Warner, Calgary (CA); Steve Parks, Fredericksburg, VA (US)

(73) Assignee: Dynamic Shelters Inc., Calgary, Alberta (CA)

( * ) Notice: Subject to any disclaimer, the term of this patent is extended or adjusted under 35 U.S.C. 154(b) by 0 days.

(21) Appl. No.: 13/740,884

(22) Filed: Jan. 14, 2013

(51) Int. Cl.
*E04B 1/34* (2006.01)

(52) U.S. Cl.
USPC ..... 52/3; 52/64; 52/79.5

(58) Field of Classification Search
USPC ..... 52/3, 64, 68, 69, 71, 79.5
See application file for complete search history.

(56) References Cited

U.S. PATENT DOCUMENTS

| | | | | | |
|---|---|---|---|---|---|
| 2,696,929 | A * | 12/1954 | Morterol | 220/4.29 |
| 3,004,543 | A * | 10/1961 | Pinet | 135/137 |
| 3,206,897 | A * | 9/1965 | Hilker et al. | 52/71 |
| 3,469,356 | A * | 9/1969 | White | 52/71 |
| 3,470,699 | A * | 10/1969 | Cox | 405/282 |
| 8,186,105 | B2 * | 5/2012 | Jackson et al. | 52/3 |
| 8,347,560 | B2 * | 1/2013 | Gyory et al. | 52/79.5 |
| 2013/0198952 | A1 * | 8/2013 | Rong et al. | 5/99.1 |

* cited by examiner

*Primary Examiner* — Basil Katcheves
(74) *Attorney, Agent, or Firm* — D. Doak Horne; Gowling Lafleur Henderson LLP

(57) ABSTRACT

Kits for assembling a protective building structure that is resistant to and protects occupants from overhead ordinance detonations, are provided. The kits comprise modular parts for assembling an overhead protective building structure that can be packaged for delivery and assembly in a field location. The kits have self-contained mechanisms for facilitating assembly of the kits with limited construction resources. A pivoting support frame permits the panel members to pivot from a vertical position for filling the panel members with fill material, to a horizontal position on the support frame, to thereby form the overhead cover. Self-raising means are also included in the kits to lift and vertically position the overhead cover along supporting stanchions positioned at each end of the support frame.

28 Claims, 44 Drawing Sheets

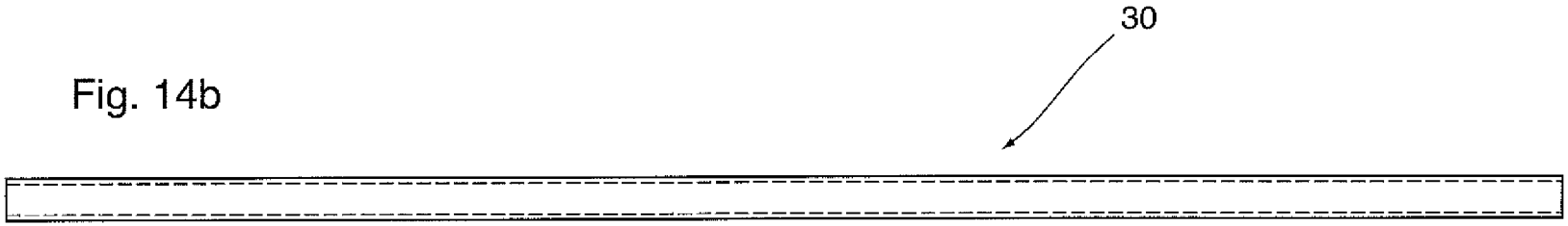
Fig. 14b
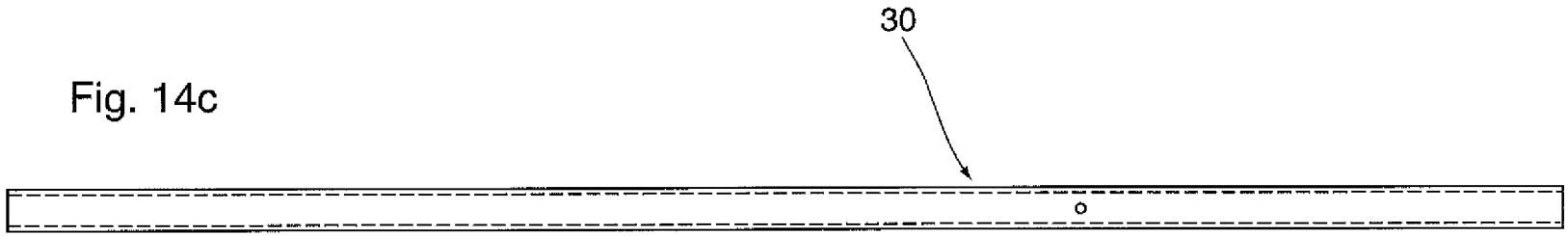
Fig. 14c
Fig. 14d

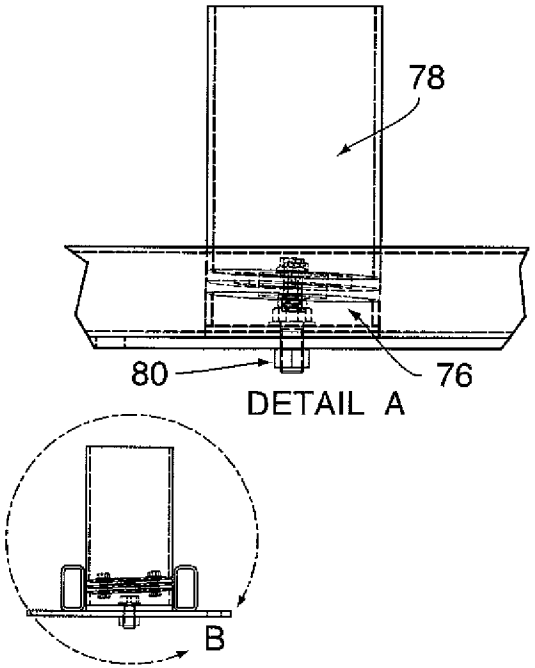
Fig. 21c
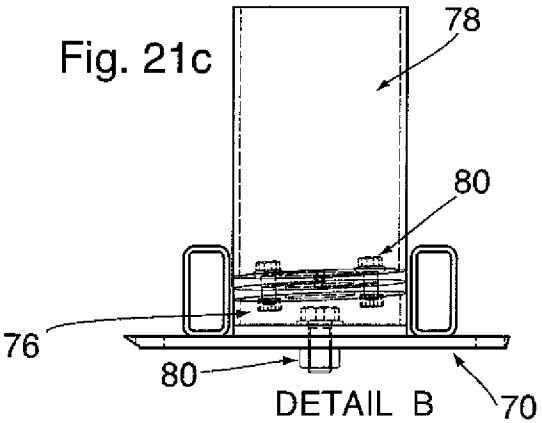
Fig. 21a
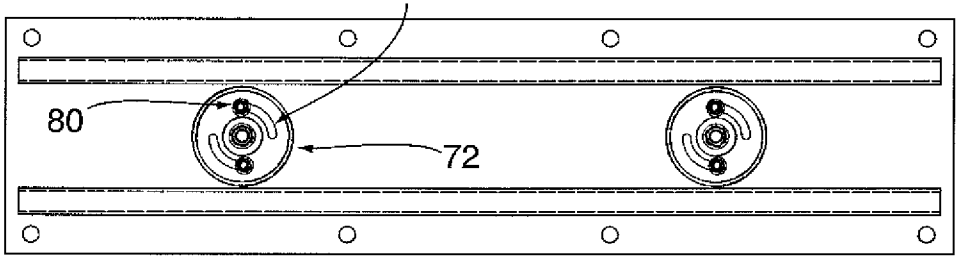
Fig. 21b
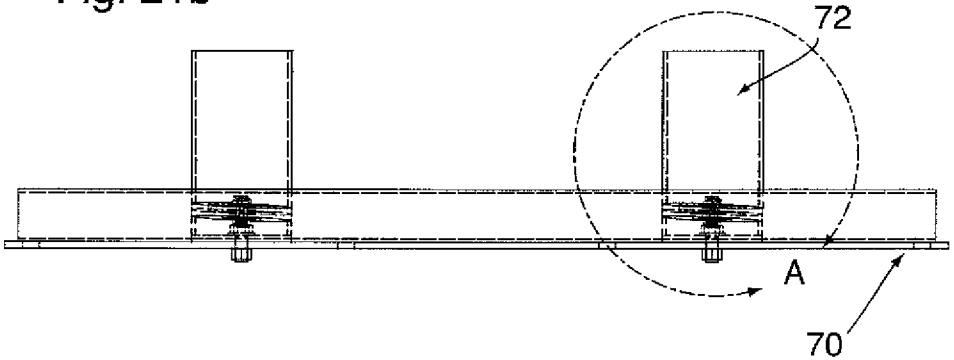

KIT FOR ASSEMBLING A BUILDING STRUCTURE RESISTANT TO OVERHEAD ORDINANCE DETONATIONS

FIELD OF THE INVENTION

The present invention pertains to the field of protective building structures, and in particular to a kit for assembling a building structure that provides protection from overhead ordinance detonations.

BACKGROUND OF THE INVENTION

The battlefield environment is often unpredictable and consistently presents challenges for the development of physical protective measures required to protect against various threat levels. The challenges of the battlefield environment place extreme demands on the performance of protective building structures designed for use in combat. Specifically, protective building structures in such environments must combine high performance capabilities, to withstand heavy explosive forces, with ease of assembly under extreme and unpredictable conditions.

Overhead protection structures have been developed to provide protection from overhead ordinance detonations. Such overhead protection structures have also been developed as modular systems to address the specific requirements of the battlefield environment. Specifically, modular systems allow structures to be packaged for delivery to a field location for assembly. However, construction resources are often limited and environmental conditions in the battlefield are often unpredictable making assembly of such systems challenging.

United States Patent Publication No. 2011/0226166 describes a blast protection system designed to be built around an existing structure in order to provide it with additional protection from explosive forces. The blast protection system comprises a support frame, a blast cover made of concrete panels, and a burster screen. The blast protection system requires concrete panels to be placed on the support frame to provide protection from overhead blasts from explosive shells, rockets, and the like. The concrete panels may be pre-formed or constructed on site and may be up to about 20 cm in thickness. The protective structures are described as reaching up to 20 meters in width, making high-mass, high-logistics resources necessary for its construction.

While modular protective building structures, similar to that described in United States Patent Publication No. 2011/0226166, provide relatively predictable levels of protection, these systems present significant logistical constraints due to their size and weight. As a result, there continues to be a need for protective building structures that can be rapidly assembled with little or no construction support and that are adaptable to unpredictable conditions.

This background information is provided for the purpose of making known information believed by the applicant to be of possible relevance to the present invention. No admission is necessarily against the present invention.

SUMMARY OF THE INVENTION

An object of the present invention is to provide a kit for assembling a protective building structure, wherein the building structure is resistant to and protects occupants from overhead ordinance detonations. In accordance with an aspect of the present invention, there is provided a kit for assembling a protective building structure, the kit comprising at least one support frame; a plurality of individual rectangular prismatic panel members, each having one end through which fill material may be placed and the panel member filled with such fill material, each of said panel members pivotably couplable to said at least one support frame, and pivotable from a vertical position where said fill material may be inserted in said panel member, to a horizontal position overlying said support frame; a plurality of elongate stanchion members, adapted, when positioned in a vertical position, at opposite ends of said support frame, to support said support frame and said panel members thereon; a plurality of coupling members, coupling said support frame to a respective of said stanchion members, said coupling members variably positionable along a respective stanchion member, further permitting fixed location of said support frame at a desired vertical height along a respective stanchion member; and raising means, for mechanically raising said support frame vertically while coupled to said stanchion members to a desired vertical height along said stanchion members.

In accordance with another aspect of the invention, there is provided a kit for assembling a protective building structure, wherein said building structure is resistant to and protects occupants from overhead ordinance detonations, the kit comprising at least one support frame; a plurality of individual rectangular prismatic panel members, each having one end through which fill material may be placed and the panel member filled with such fill material, each of said panel members pivotably couplable to said at least one support frame, and pivotable from a vertical position where said fill material may be inserted in said panel member, to a horizontal position overlying said support frame; a plurality of elongate stanchion members, adapted, when positioned in a vertical position, at opposite ends of said support frame, to support said support frame and said panel members thereon; a plurality of coupling members, coupling said support frame to a respective of said stanchion members, said coupling members variably positionable along a respective stanchion member, further permitting fixed location of said support frame at a desired vertical height along a respective stanchion member; raising means, for mechanically raising said support frame vertically while coupled to said stanchion members to a desired vertical height along said stanchion members; and a container for packing said kit for delivery to a field location for assembly.

In accordance with another aspect of the invention, there is provided a kit for assembling a protective building structure, wherein said building structure is resistant to and protects occupants from overhead ordinance detonations, comprising at least one support frame; a plurality of individual rectangular prismatic panel members, each having one end through which fill material may be placed and the panel member filled with such fill material, each of said panel members pivotably couplable to said at least one support frame, and pivotable from a vertical position where said fill material may be inserted in said panel member, to a horizontal position overlying said support frame; a plurality of elongate stanchion members, adapted, when positioned in a vertical position, at opposite ends of said support frame, to support said support frame and said panel members thereon; a plurality of base plates configured to receive said stanchion members and position said stanchion members at opposite ends of said support frame, each of said plurality of base plates adapted to adjust orientation of said corresponding stanchion member in said vertical position relative to a sloping grade; a plurality of coupling members, coupling said support frame to a respective of said stanchion members, said coupling members variably positionable along a respective stanchion member, further permitting fixed location of said support frame at a desired vertical height along a respective stanchion member; and raising means, for mechanically raising said support frame vertically while coupled to said stanchion members to a desired vertical height along said stanchion members.

BRIEF DESCRIPTION OF THE FIGURES

In the accompanying drawings, which illustrate one or more exemplary embodiments:

FIGS. 21 (*a*), (*b*), and (*c*) are top and side perspective, and cross-sectional views of the base sockets, according to embodiments of the present invention;

DETAILED DESCRIPTION OF THE INVENTION

Definitions

The term "ballistic material", as used herein, refers to materials that generally are designed to resist penetration by bullets and other ballistic projectiles.

The term "fill material", as used herein, refers to material used to fill a panel member of the present invention. The fill material can be locally obtained and can include such materials as earth, sod, and gravel. In other embodiments the fill material is prepared on site, for example, concrete.

As used herein, the term "about" refers to a +/−10% variation from the nominal value. It is to be understood that such a variation is always included in any given value provided herein, whether or not it is specifically referred to.

Unless defined otherwise, all technical and scientific terms used herein have the same meaning as commonly understood by one of ordinary skill in the art to which this invention belongs.

The kit according to the present invention comprises modular parts for assembling an overhead protective building structure that can be packaged for delivery and assembly in a field location. The kit of the present invention further comprises self-contained mechanisms that facilitate the assembly of the building structure with limited construction support. In particular, the kit of the present invention provides mechanical means for facilitating the filling and raising of the overhead protective panels of the protective building structure of the present invention.

The modular nature of the kit of the present invention allows protective building structures of a variety of sizes to be assembled. In addition, the kit of the present invention is adaptable to the unpredictable nature of the battlefield environment. In this regard, the kit of the present invention permits the protective building structure to be assembled and situated on uneven terrain by adjusting to the varying slope. In some embodiments the protective building structure can compensate for a slope up to 6 pct cross slope. In other embodiments, the protective building structure can compensate for terrain having varying grades.

Figure 1A:
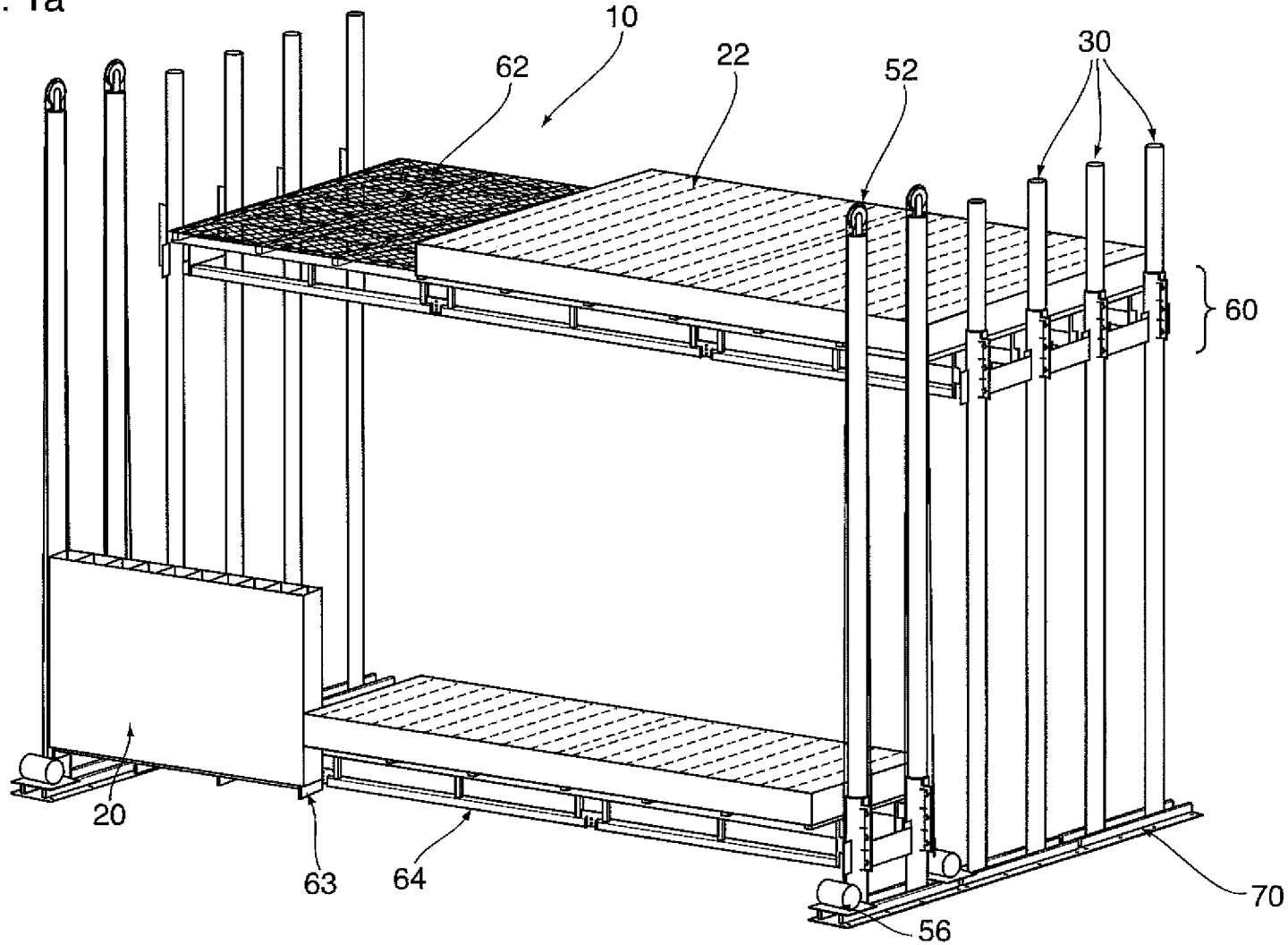
FIGS. 1(*a*), (*b*), and (*c*) are front, back and side perspective views, respectively, of a protective building structure kit in various states of assembly, according to embodiments of the present invention.
Figure 1B:
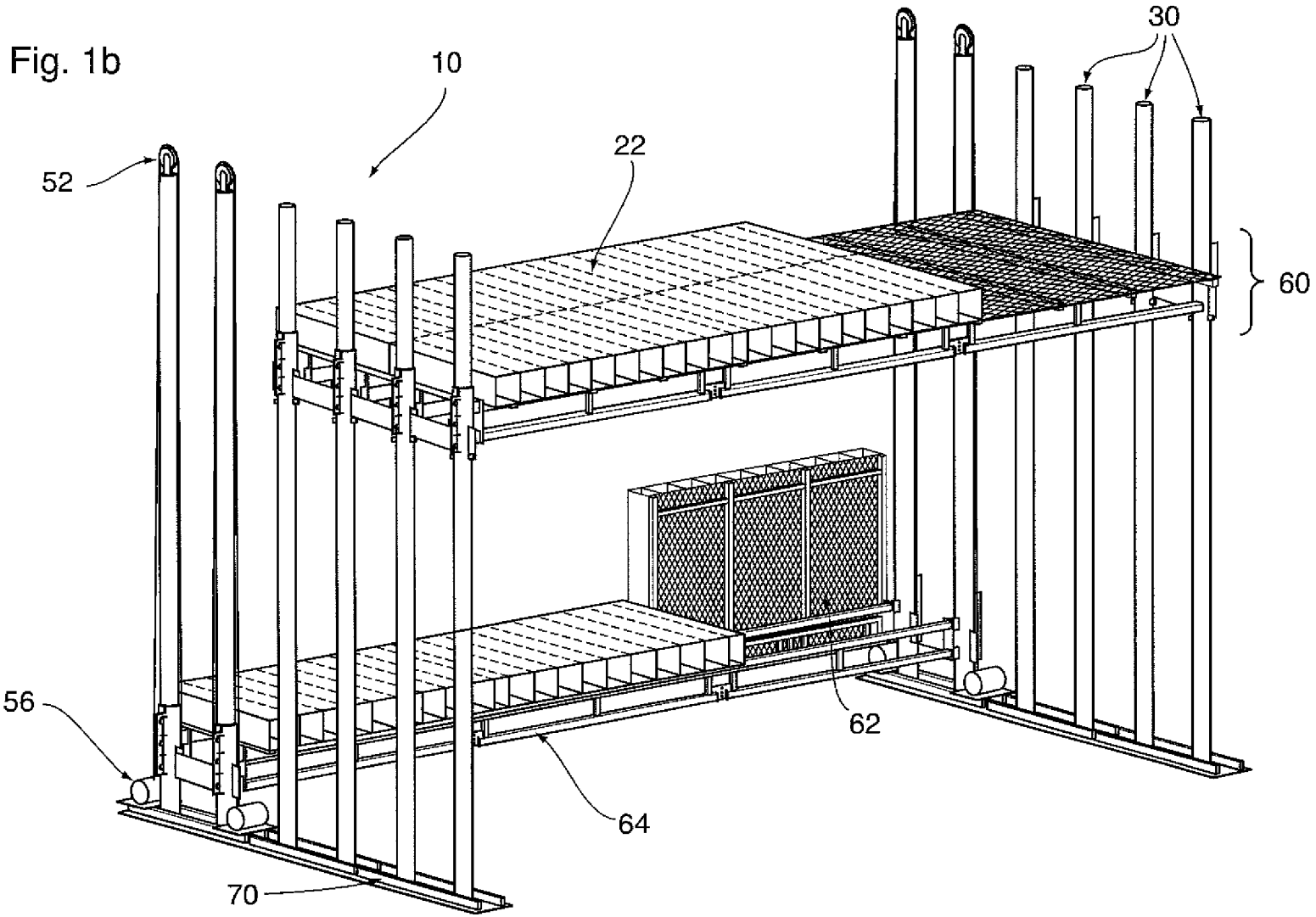
Figure 1C:
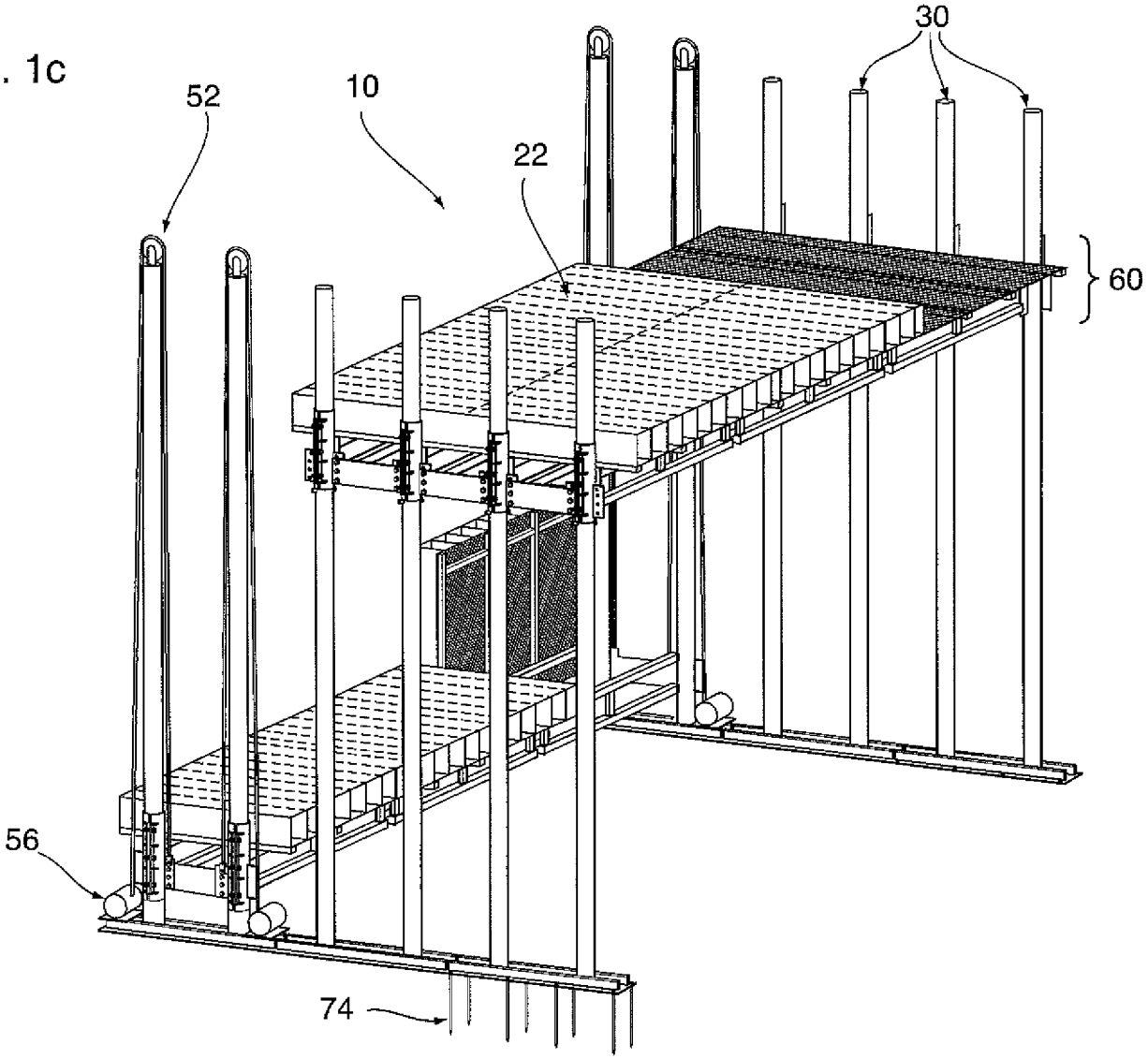

Referring to the drawings, in which like reference numerals identify identical or substantially similar parts throughout the several views, the present invention can be best understood by starting with a functional diagram. FIGS. 1(*a-c*) illustrate the protective building structure kit 10 in various states of assembly according to embodiments of the present invention. The kit 10 includes a support frame 60 for supporting a plurality of panel members 20 which, together, form the overhead cover 22 that provides protection from incoming ordinance detonations. The support frame 60 is supported by a plurality of stanchion members 30 vertically positioned at opposite ends of the support frame 60.

Figure 2:
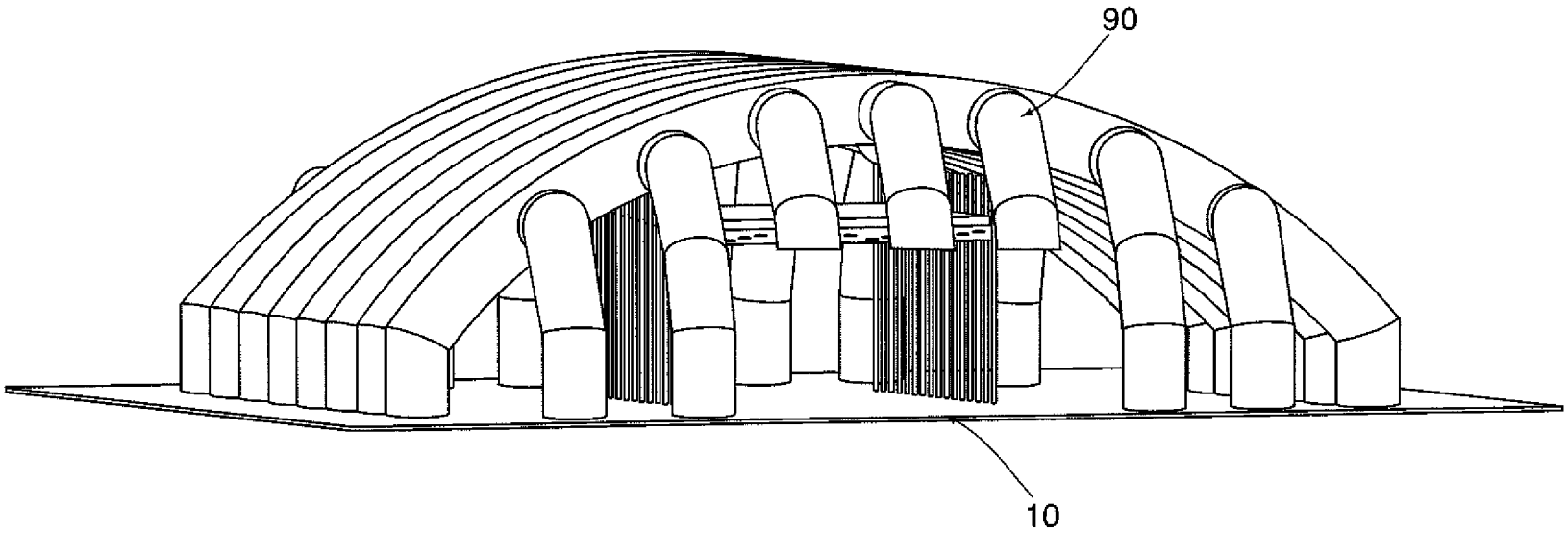
FIG. 2 is a perspective view of a kit assembled for use within a shelter; according to embodiments of the present invention.

The overhead cover 22, of the assembled kit, shields, deflects, and/or absorbs the destructive forces of any incoming ordinance, thereby, providing overhead protection to occupants, equipment, or materials. In some embodiments, the kit of the present invention can be used to provide additional overhead protection for temporary shelters. Depending on the intended use, the kit can be assembled within the shelter 90 (FIG. 2), or in other embodiments, the kit can be assembled exterior to the shelter to provide the overhead protection.

Pivoting Support Frame—Filling and Loading Panel Members

Figure 3A:
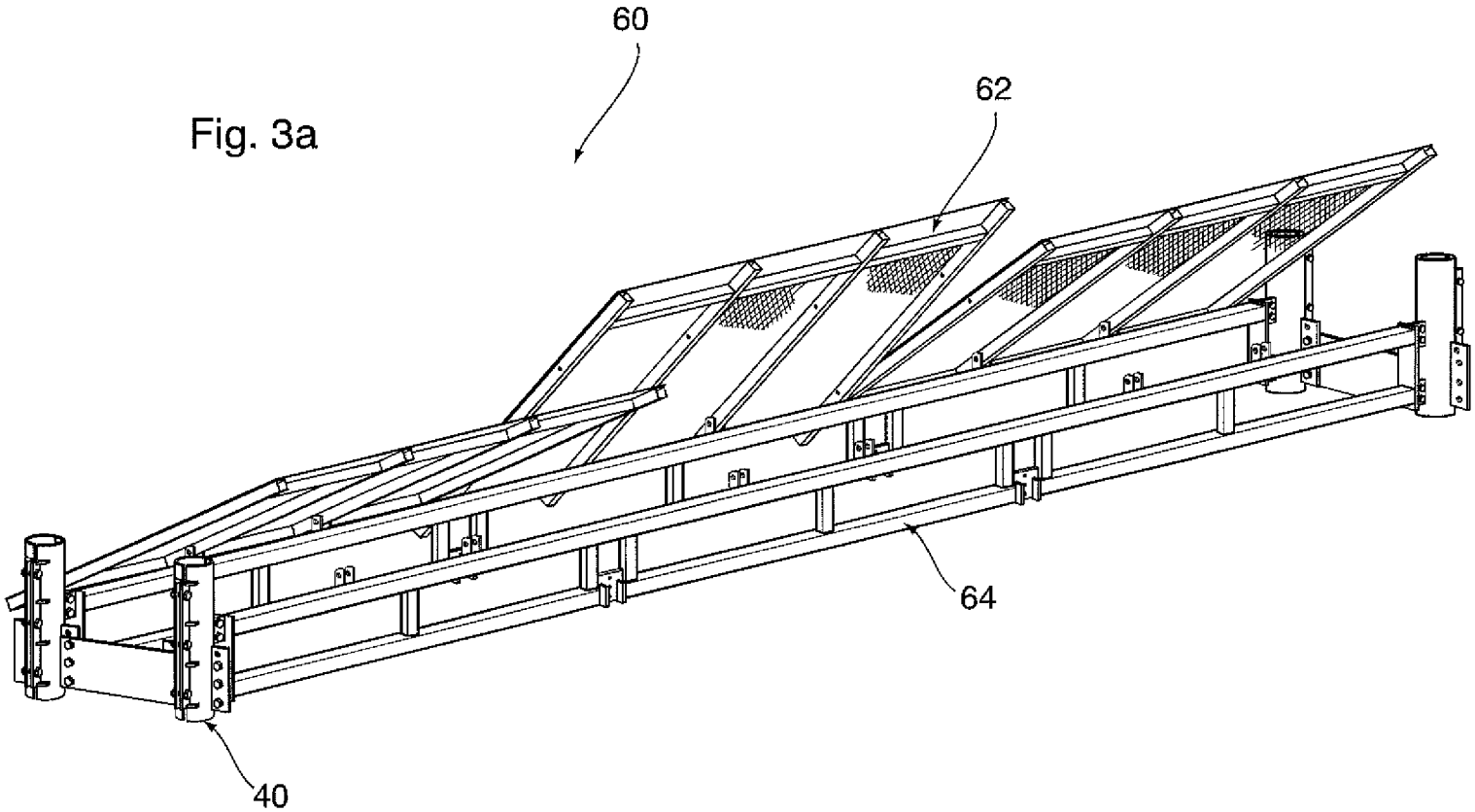
FIGS. 3 (*a*) and (*b*) are perspective views of a support frame pivoting between vertical and horizontal positions, according to embodiments of the present invention.
Figure 3B:
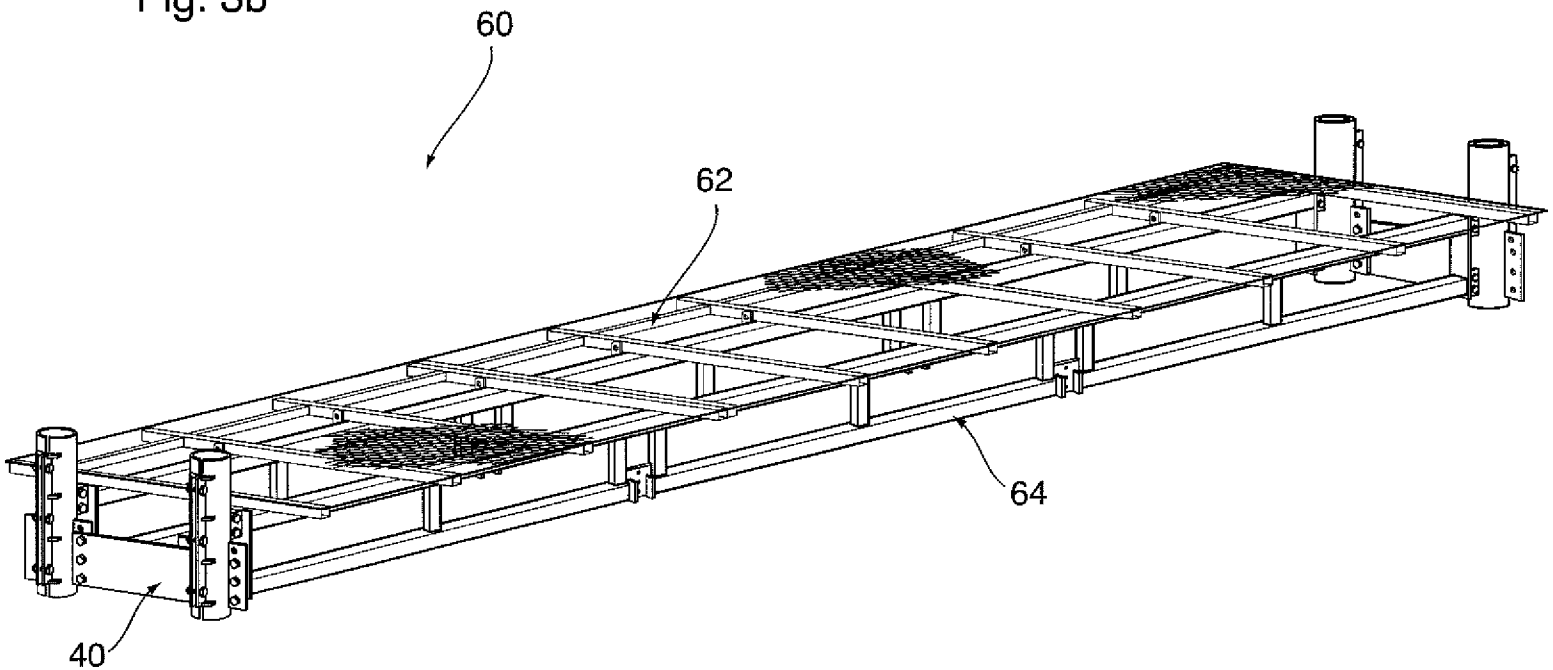
Figure 4:
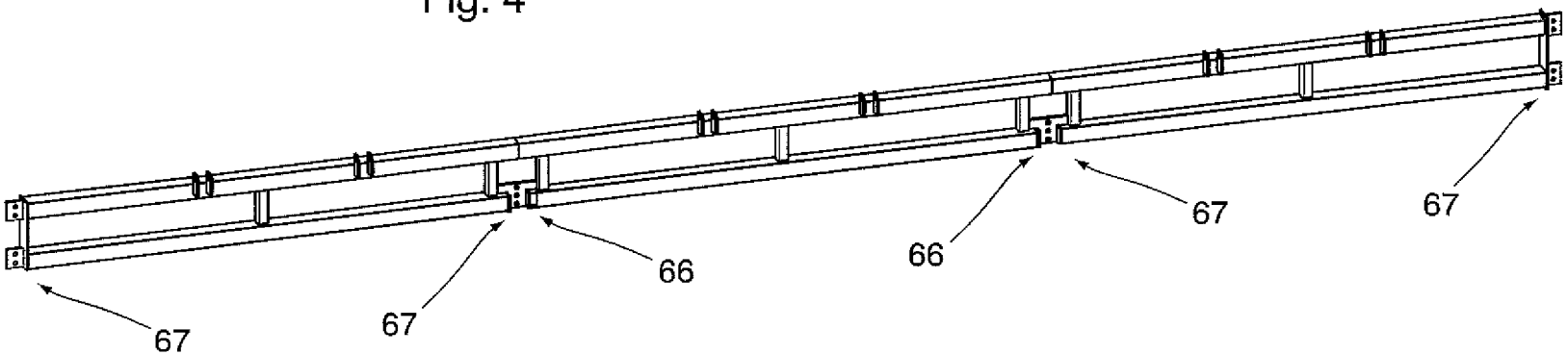
FIG. 4 is a perspective view of a single truss assembly, according to embodiments of the present invention.
Figure 5A:
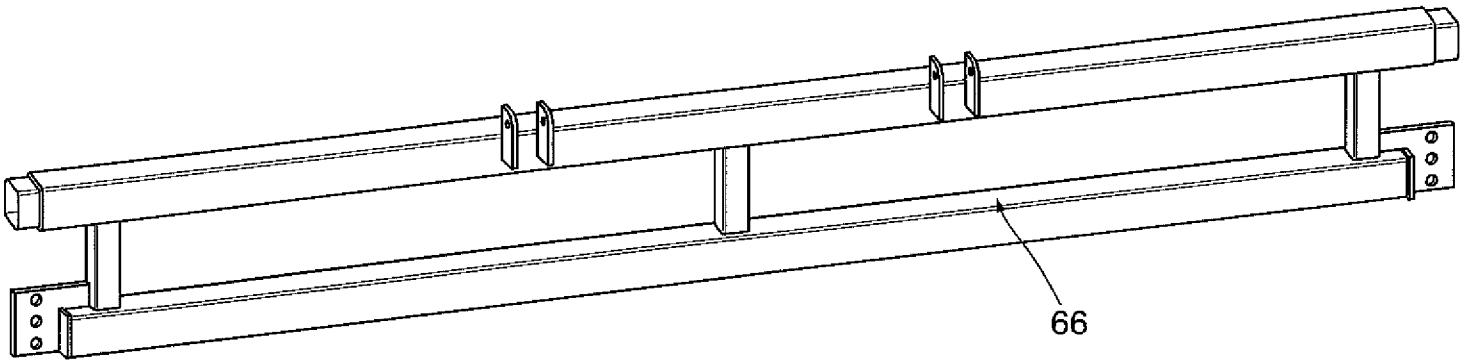
FIGS. 5 (*a*), (*b*), (*c*), and (*d*) are perspective, top, side, and end views of a middle truss subassembly, according to embodiments of the present invention.
Figure 5B:
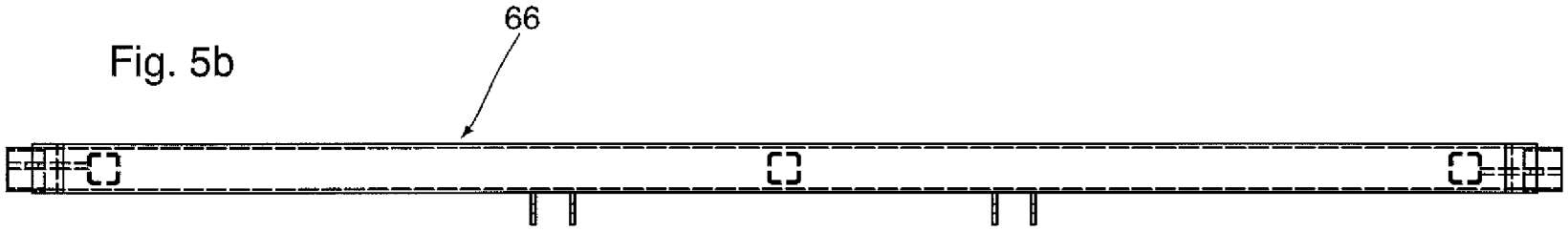
Figure 5C:
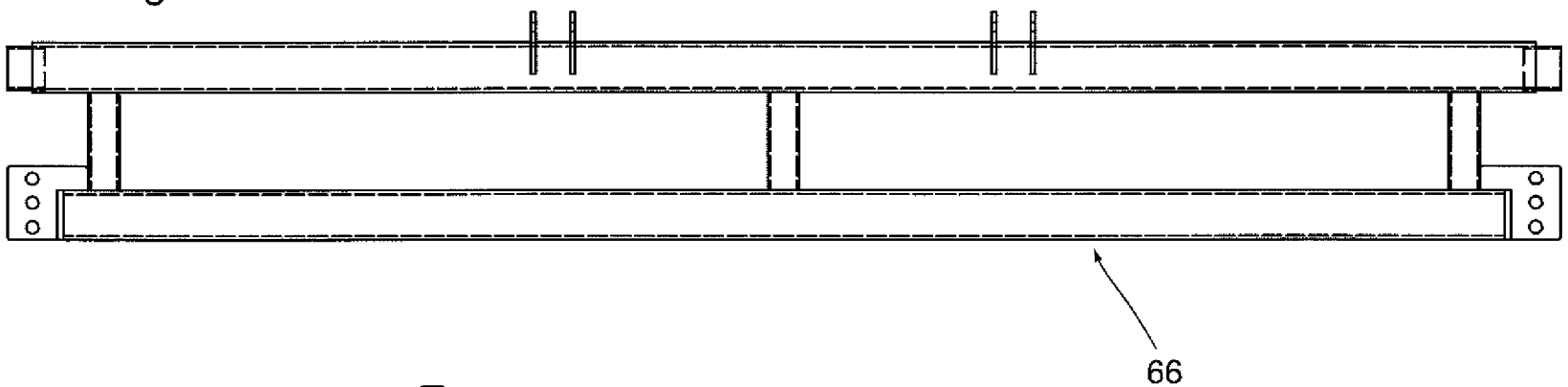
Figure 5D:
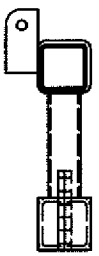
Figure 6A:
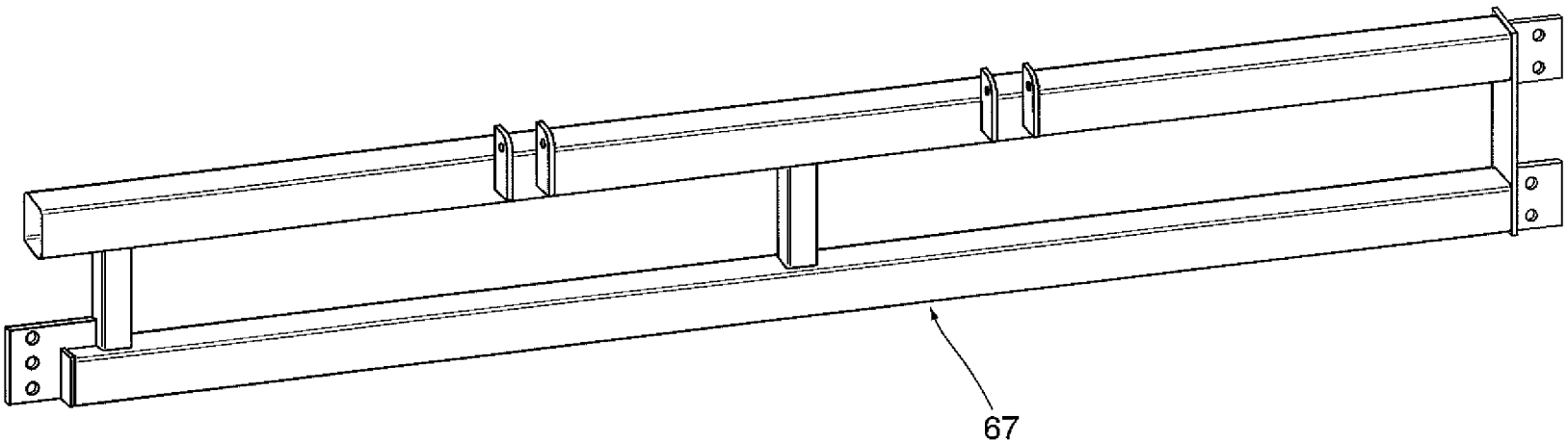
FIGS. 6 (*a*), (*b*), (*c*), and (*d*) are perspective, top, end, and side views of an end truss subassembly, according to embodiments of the present invention.
Figure 6B:
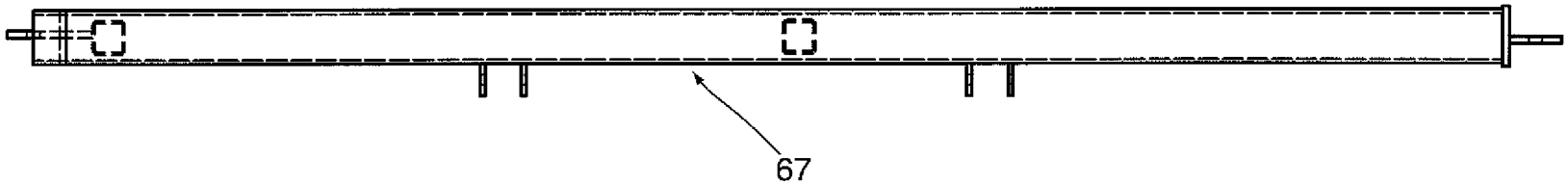
Figure 6D:
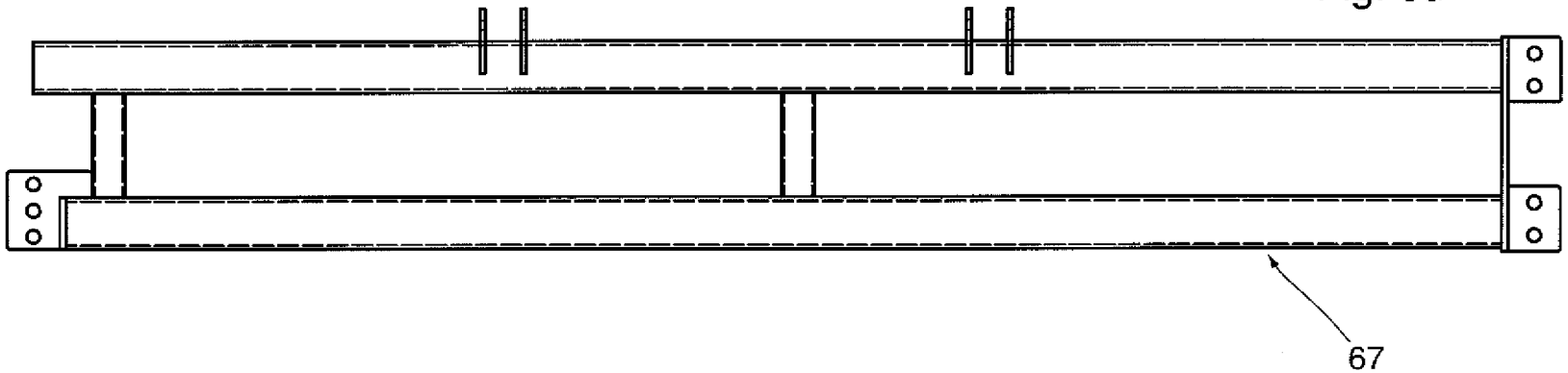
Figure 6C:
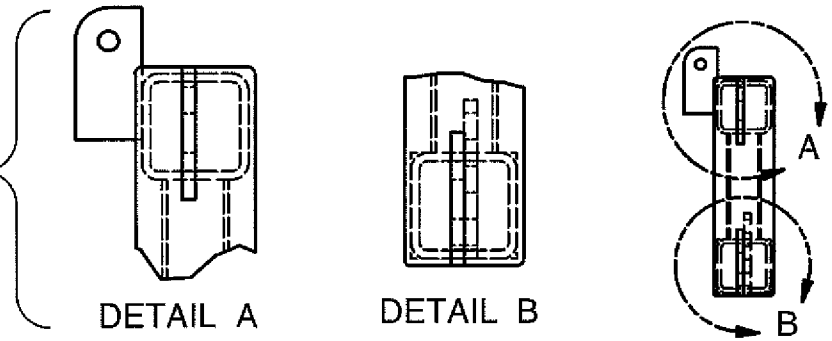
Figure 7:
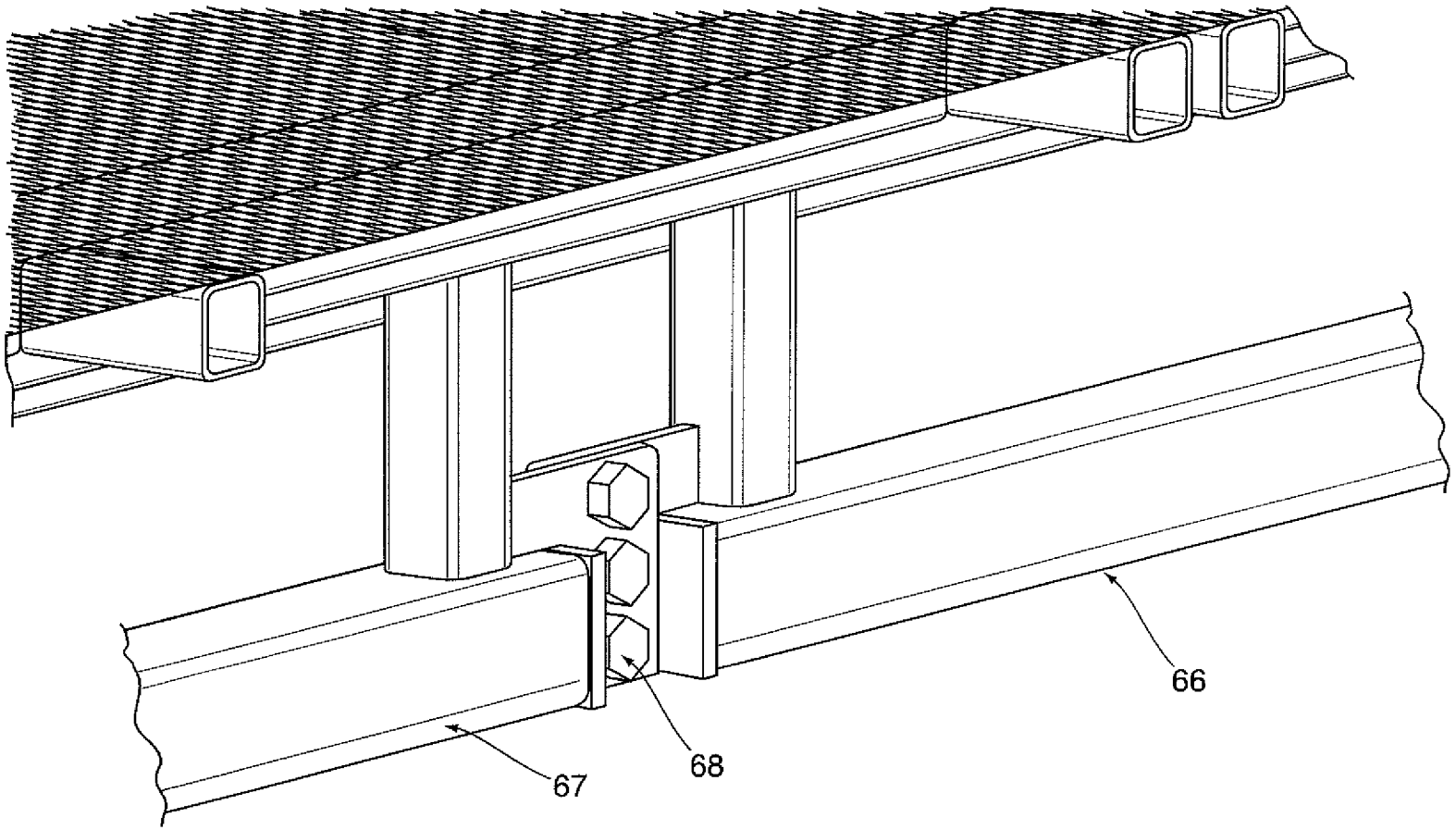
FIG. 7 is a perspective view of a truss subassembly connection plate connecting a truss assembly, according to embodiments of the present invention.
Figure 8A:
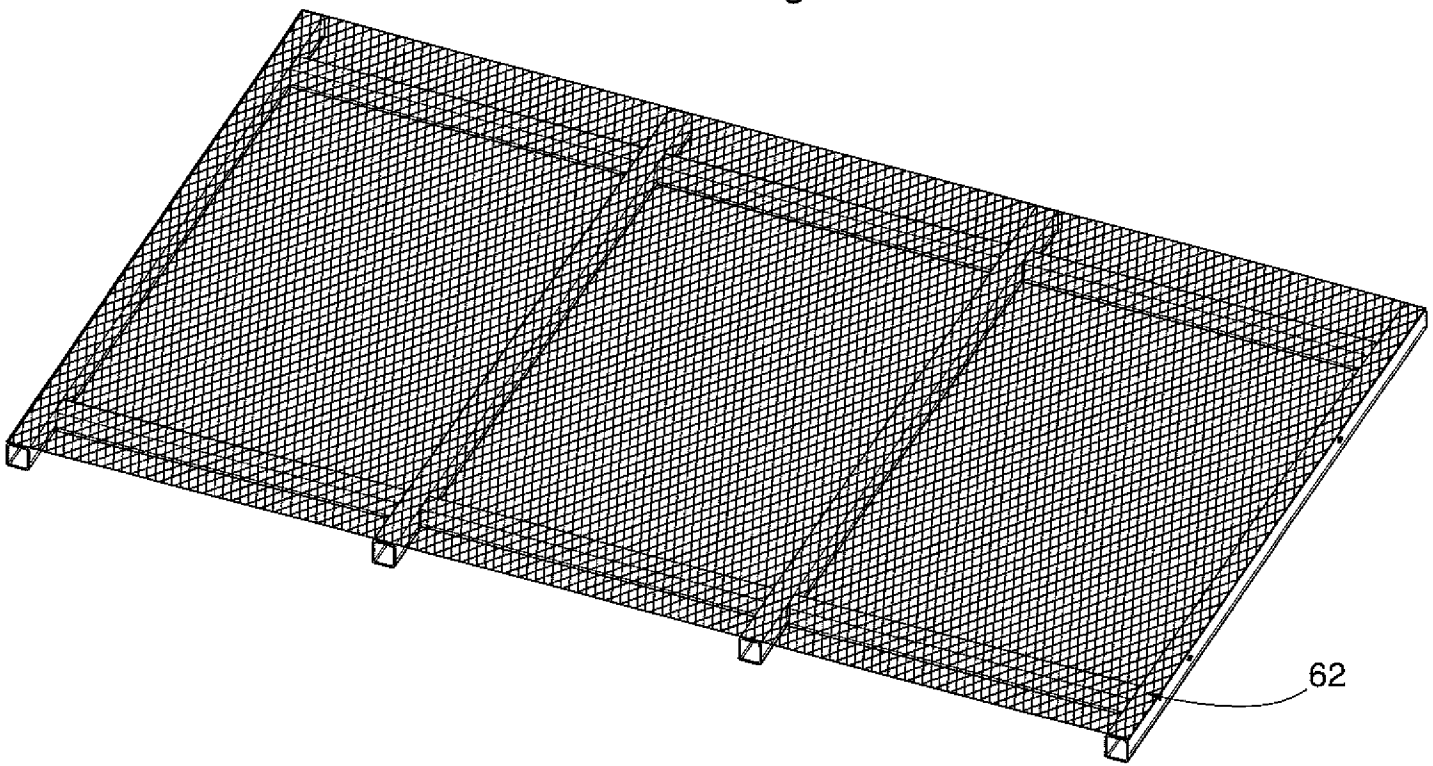
FIGS. 8 (*a*), (*b*), (*c*) and (*d*) are perspective, side, top, and end views of a support platform, according to embodiments of the present invention.
Figure 8D:
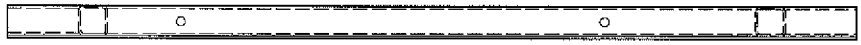
Figure 8B:
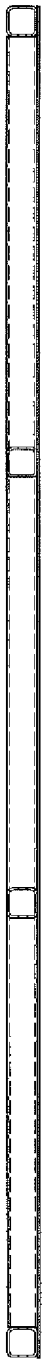
Figure 8C:
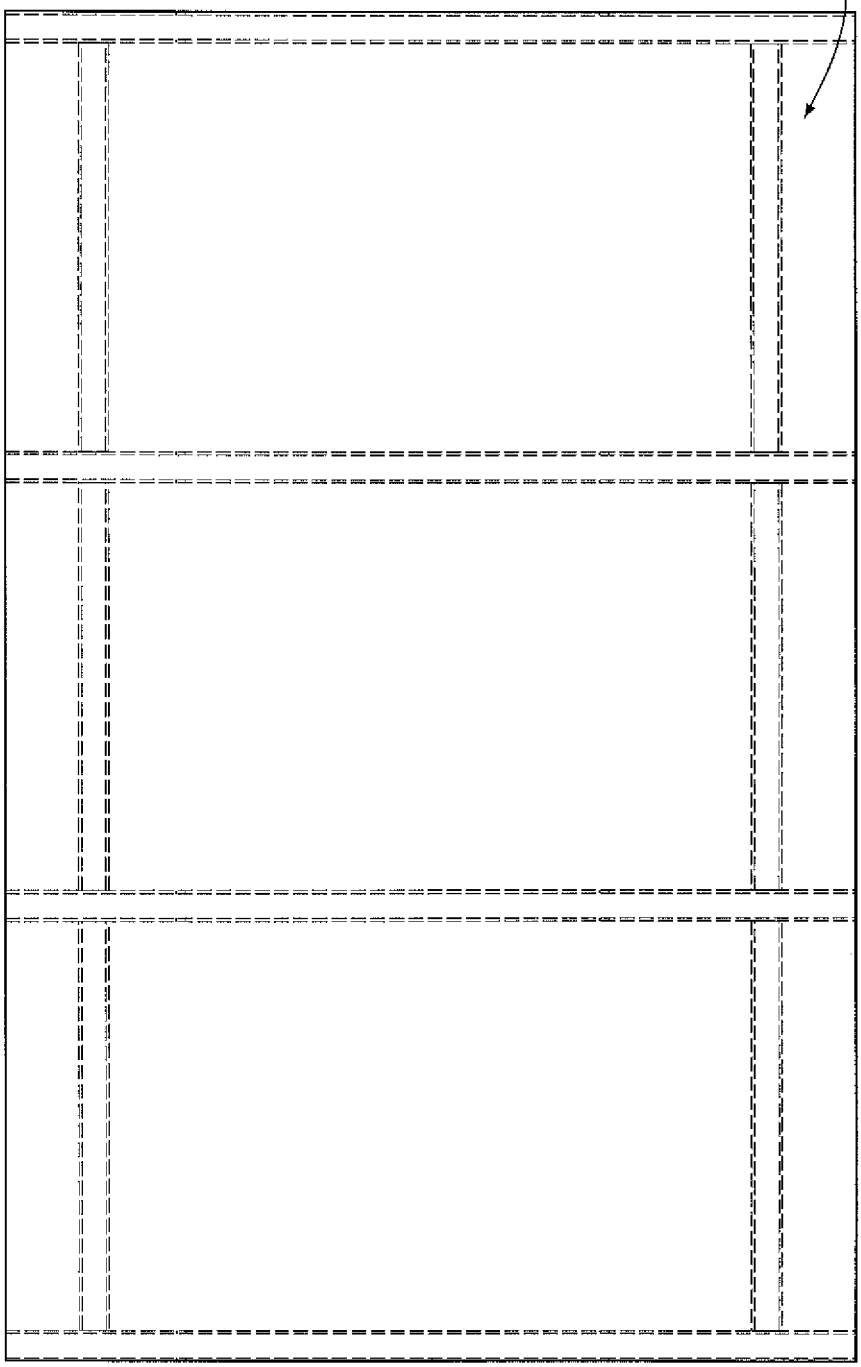

The support frame 60 (FIGS. 3(*a-b*)) comprises a support platform 62 hingably connected to a truss assembly 64 thereby allowing the support platform 62 to pivot between a vertical position and a horizontal position, relative to the truss assembly 64. To faciliate ease in packing the kit of the present invention, the support frame 60 can be provided in modular form in certain embodiments. For example, the truss assembly 64 (FIG. 4) can comprise three component subassemblies, a middle truss subassembly 66 connected at either end to a corresponding end truss subassembly 67 (FIGS. 5 (*a-d*) and FIGS. 6 (*a-d*), respectively). The respective truss subassemblies are connected by a truss subassembly connection plate 68 to form a truss assembly 64 of a desired length (FIG. 7) to accommodate the overlying support platform 62. The support platform 62 can also be provided in modular form, as illustrated in FIGS. 8 (*a-d*), such that a plurality of individual support platforms 62 together form an overhead cover 22.

Accordingly, embodiments of the present invention comprise a truss assembly 64 sized to accommodate a plurality of support platforms 62. In one embodiment, the truss assembly 64 is sized to accommodate three support platforms 62. For example, an embodiment of the present invention can comprise a middle truss subassembly that is about 3.17 meters in length and each end truss subassembly about 3.0 meters in length, to provide an assembled truss assembly of about 9.34 meters in length that will support three support platforms 62 each being about 2.88 meters×1.83 meters.

Figure 9:
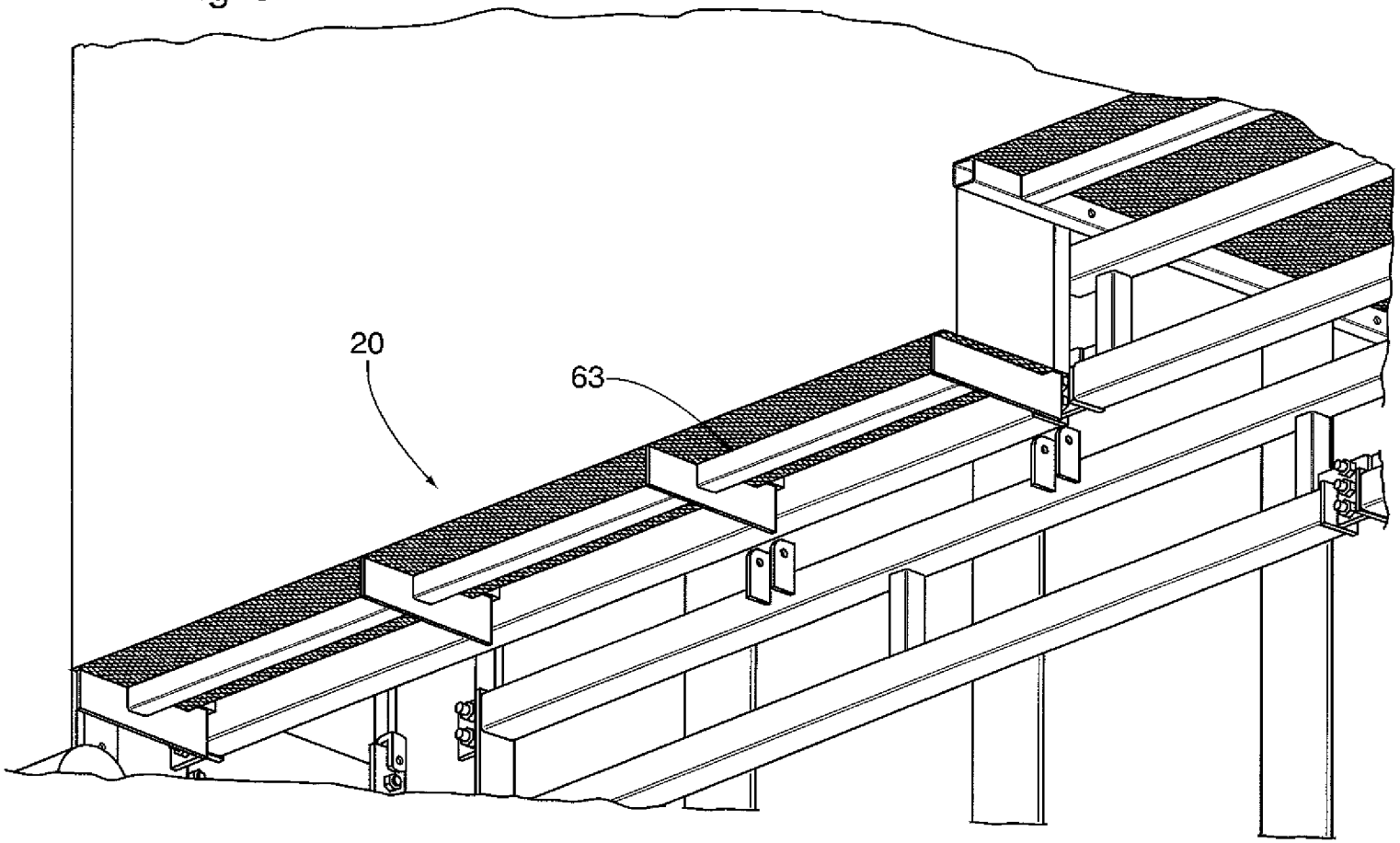
FIG. 9 is a perspective view of a panel member in the vertical position, according to embodiments of the present invention.

As shown in FIGS. 1 (*a-d*), each of the support platforms 62 provides support for a corresponding panel member 20. The panel member 20 is coupled to the support platform 62 such that pivoting of the support platform 62 relative to the truss assembly 64 allows the respective panel member 20 to pivot between a vertical and horizontal position. When in the vertical position, the panel member 20 is positioned for filling with fill material. Once the panel member 20 has been filled, the support platform 62 together with the filled panel member 20 is pivoted to the horizontal position on the truss assembly 64. In this way, filling of a panel member 20 with fill material is facilitated without requiring additional resources to position a panel member 20 for filling and loading onto the support frame 60. In one embodiment, the support platform 62 further comprises a removable bottom panel 63 for supporting the bottom of the panel member 20 during filling in the vertical position (FIG. 9).

Figure 10A:
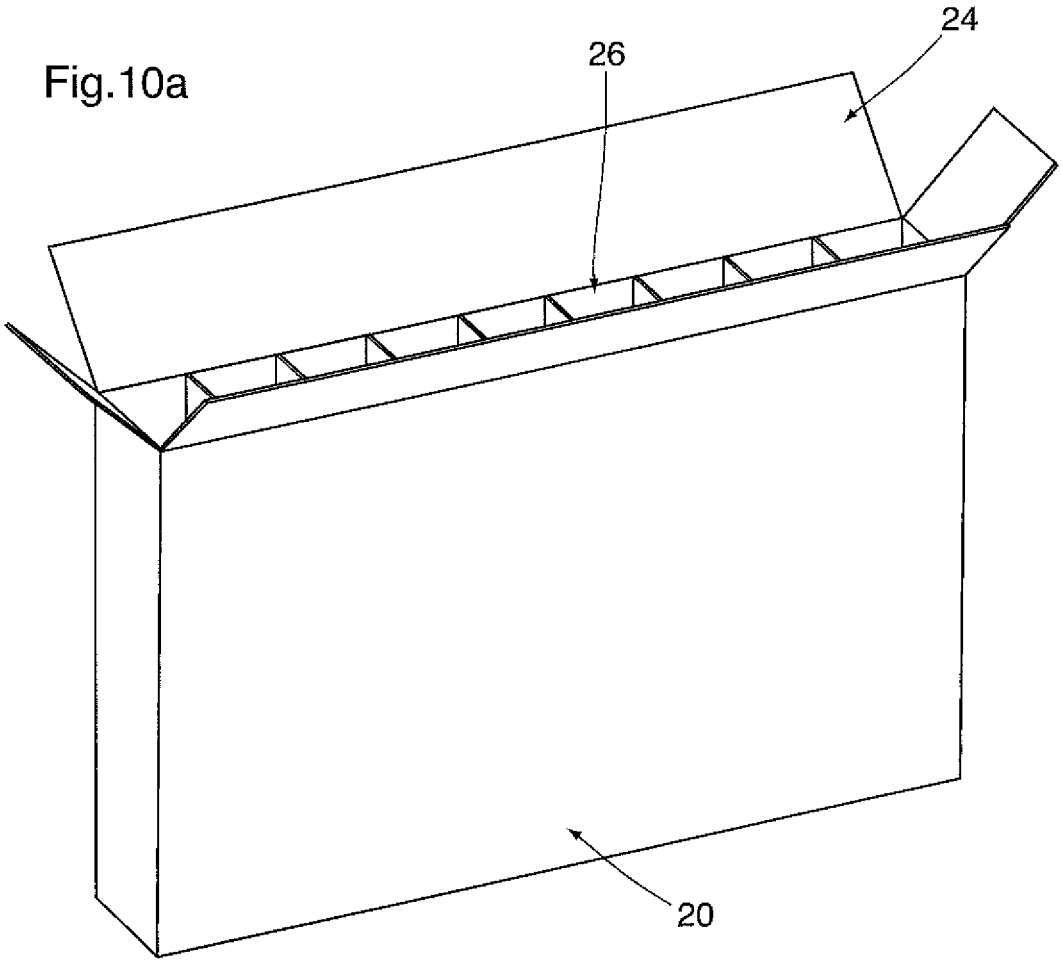
FIGS. 10 (*a*) and (*b*) are side perspective and top perspective views of a panel member, according to embodiments of the present invention.
Figure 10B:
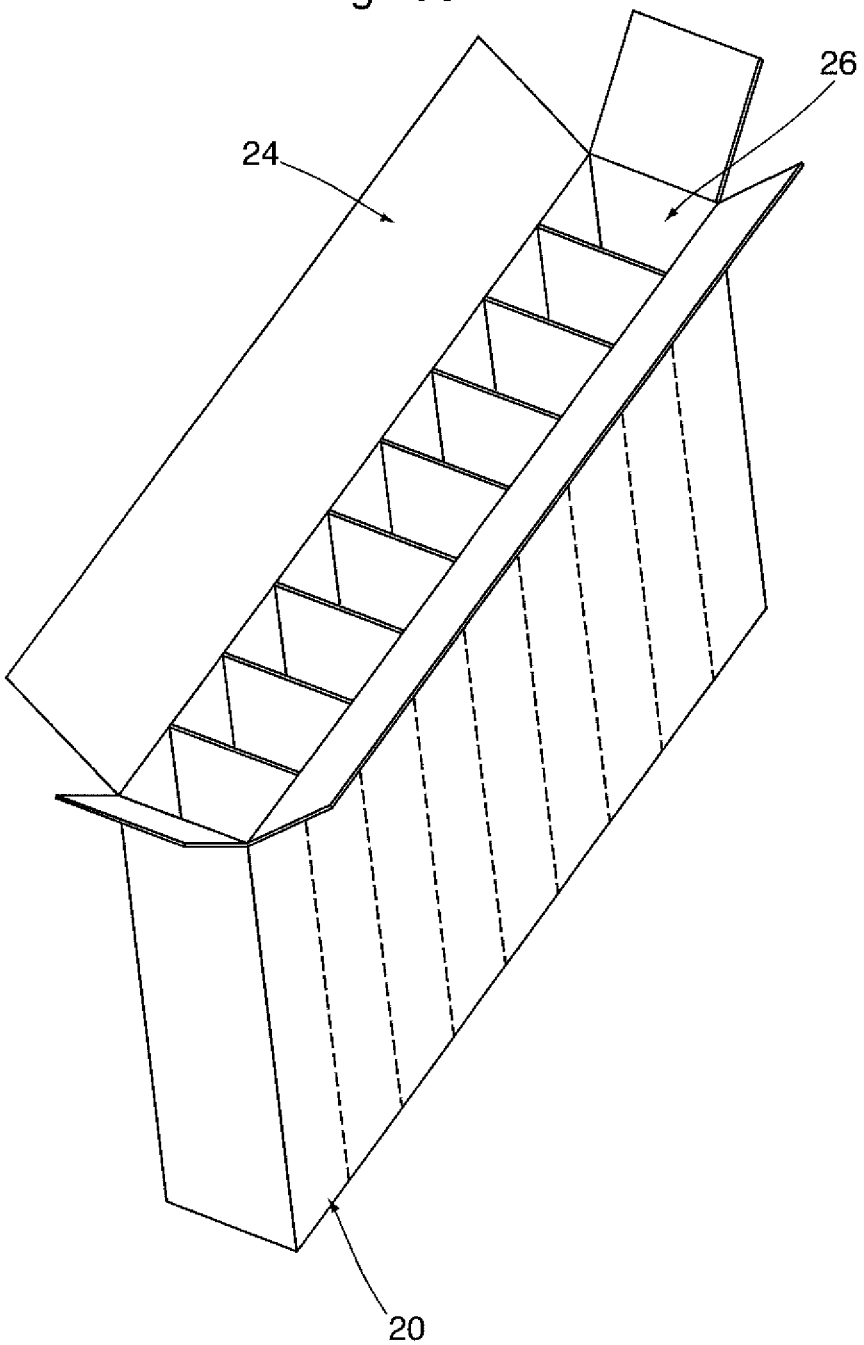

As shown in FIGS. 10 (*a-b*), the panel member 20 can comprise a plurality of cells 26 formed by internal partitions extending through said panel member 20 that provide rigidity to the panel member 20 to facilitate positioning of the panel member 20 for filling. Once the panel member 20 is filled, the opening of the panel member is closed in order to contain the fill material inside. In one embodiment, as shown in FIGS. 10 (*a*) and (*b*), the panel member 20 comprises flaps 24 which can be folded down to close the opening of the panel member 20.

Figures 11A, 11B, 11C:
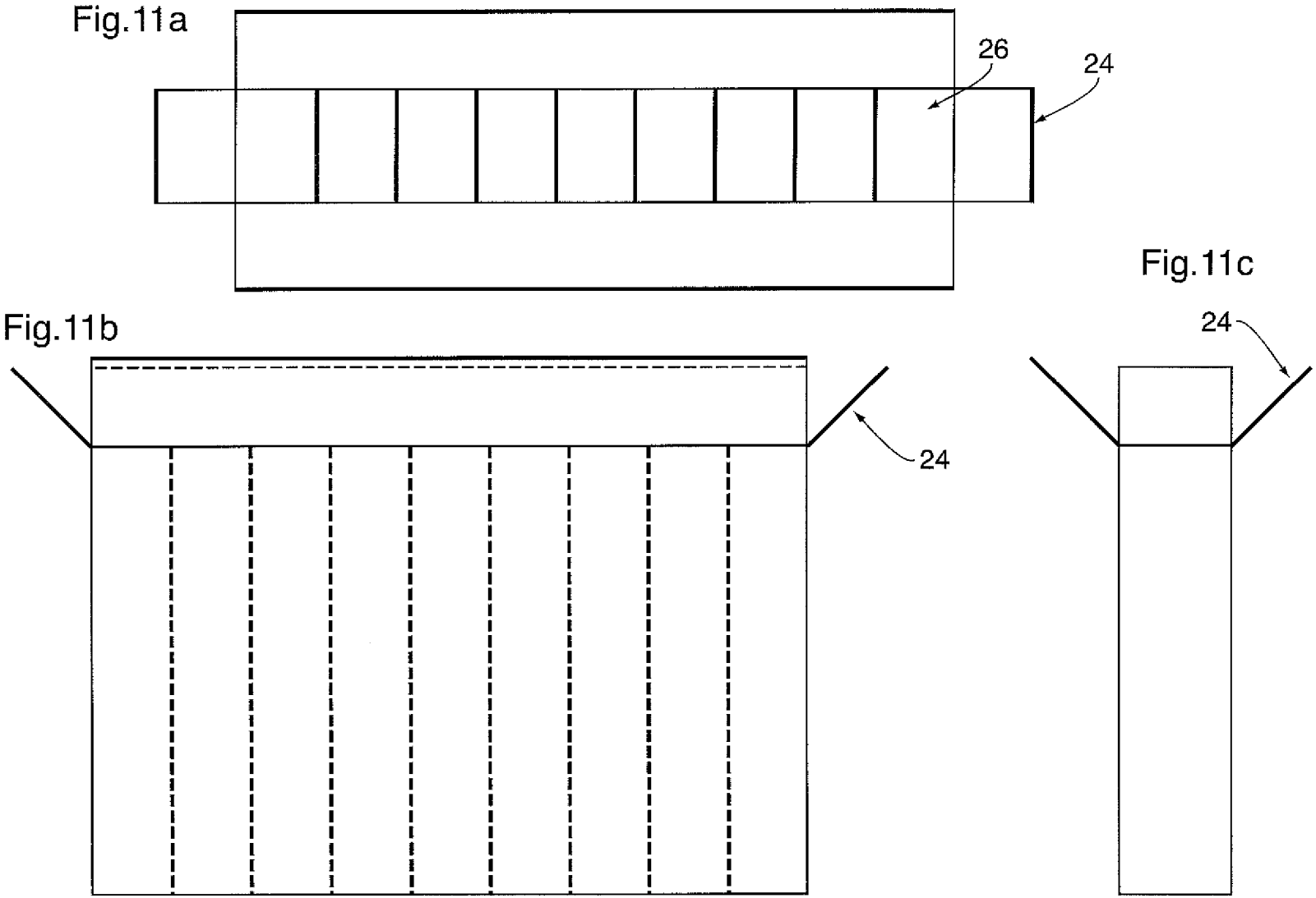
FIGS. 11 (*a*), (*b*), and (*c*) are top, side, and end views of a panel member, according to embodiments of the present invention.

Each panel member 20 corresponds in size with a respective support platform 62 so as to enable pivoting of the panel member 20 by the support frame 60. Accordingly, embodiments of the kit comprising a plurality of support platforms 62 will comprise an equal number of correspondingly sized panel members 20. For example, FIGS. 11 (*a-c*) illustrate a panel member 20 according to embodiments of the invention, having dimensions that are about 2.92 meters×1.83 meters×0.46 meters and comprise cells that are 0.323 meters×1.83 meters. The panel member 20 is adapated for filling to a sufficient thickness to resist and protect occupants from overhead ordinance detonations. In the illustrated embodiment, the panel member has a thickness of about 0.46 meters.

The panel members 20 are structurally rigid and can be composed of ballistics materials that generally are designed to resist penetration by bullets and other ballistic projectiles. Examples of ballistic materials include rigid, lightweight composite materials (e.g., high-density plastic, steel, aluminum, resin composite material, titanium, etc.) and/or composite woven fiber materials such as KEVLAR™ (a light, strong para-aramid synthetic fiber, with high strength-to-weight ratio), VECTRAN™ (an aromatic polyester fiber noted for thermal stability at high temperatures, high strength and modulus, low creep, chemical stability, and moisture resistance), DYNEEMA™ (a strong polyethylene fiber with high strength-to-weight ratio that is resistant to moisture, UV light and chemicals), and/or various fiberglass compositions. In other embodiments the panel members 20 can be composed of a monolithic material or mixture of materials. One of ordinary skill in the art will recognize a variety of suitable materials that can be used to form the panel members 20.

Self-Raising Mechanism—Vertical Positioning of Overhead Cover

The kit of the present invention includes a self-raising mechanism for lifting and lowering the overhead cover 22. In this way, assembly, adjustment, and dismantling of the overhead protective building structure can be achieved even in situations where construction resources are limited.

Figure 12:
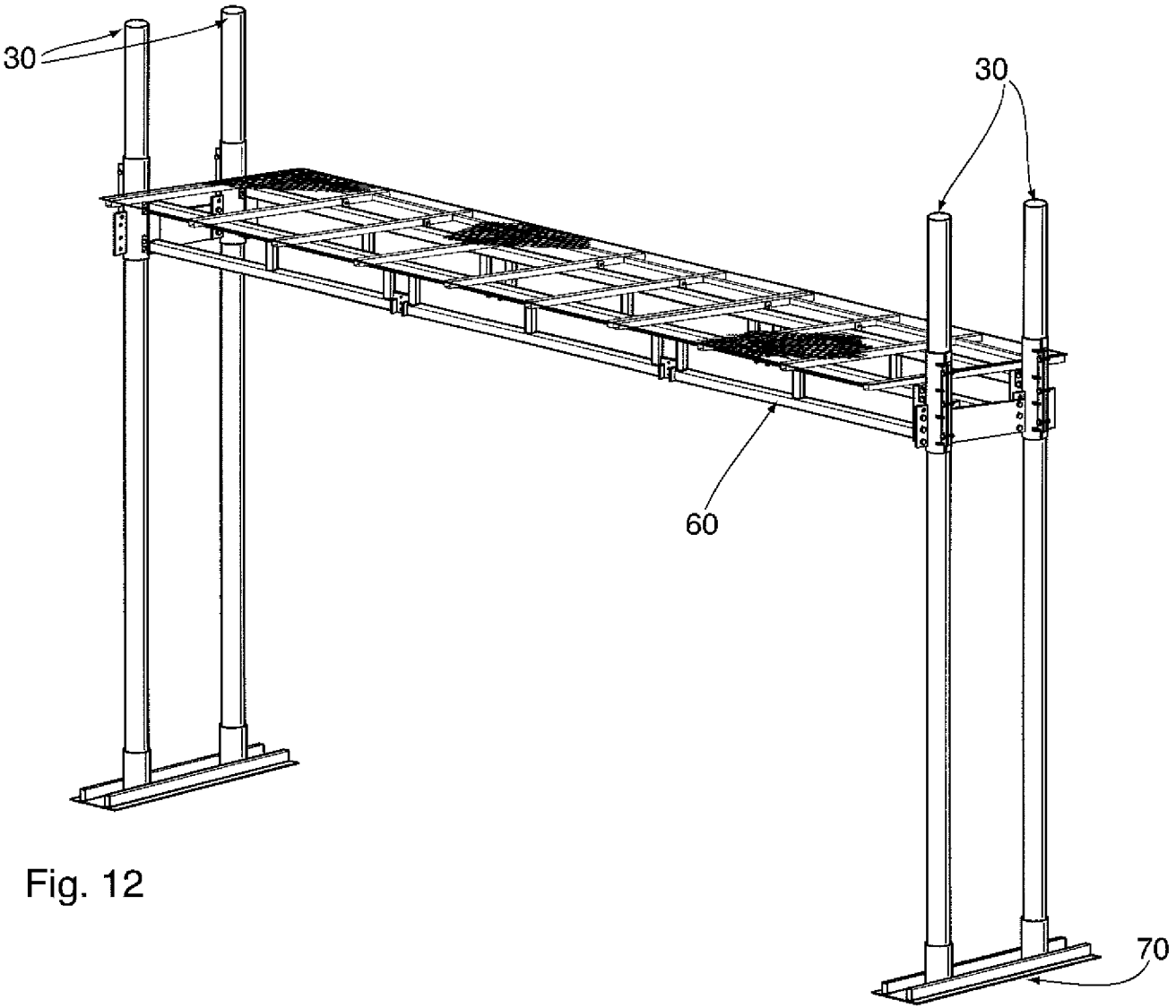
FIG. 12 is a perspective view of a single assembled protective building structure (panel members not shown), according to embodiments of the present invention.
Figure 13:
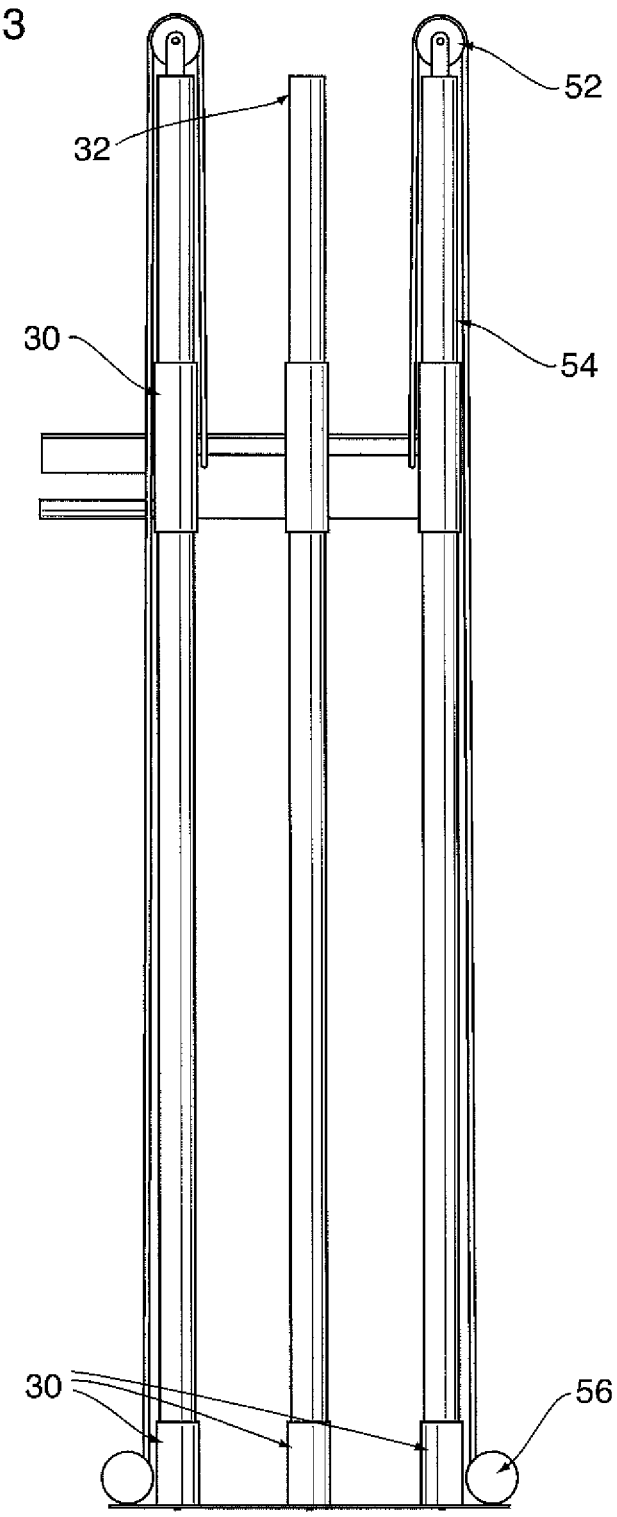
FIG. 13 is a side view of a single assembled protective building structure, according to embodiments of the present invention.

The support frame 60 is supported by a plurality of stanchion members 30. The stanchion members 30 are coupled at each corner of the support frame 60 (FIG. 12). In some embodiments, the support frame 60 is supported by an additional stanchion member 30 coupled to the support frame 60 in between the corner stanchions 60 to provide additional support (FIG. 13) to the assembled protective building structure.

Figure 14A:
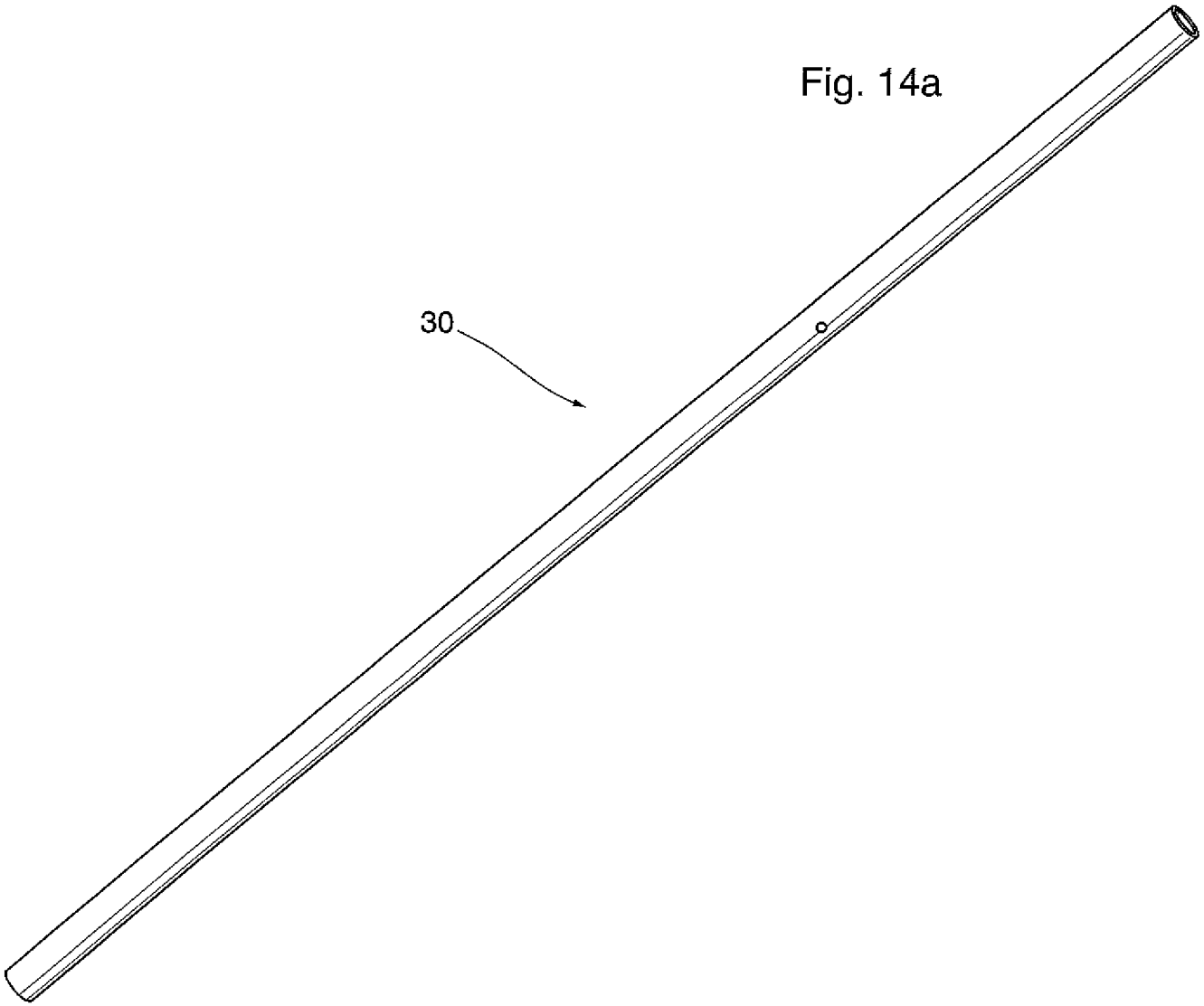
FIGS. 14 (*a*), (*b*), (*c*) and (*d*) are perspective, longitudinal, and end views of an assembled stanchion, according to embodiments of the present invention.

The stanchion members 30 can be provided in modular form in certain embodiments to faciliate ease in packing the kit of the present invention. In such embodiments, the stanchion members comprise a plurality of segments that fittingly engage to form a final length. FIGS. 14 (*a-d*) show a fully assembled stanchion member in accordance with embodiments of the present invention. As illustrated in FIGS. 14 (*b-d*), in one example of embodiments of the present invention, the final length of the stanchion members can measure 6.4 meters and have a diameter of about 0.17 meters.

Figure 15:
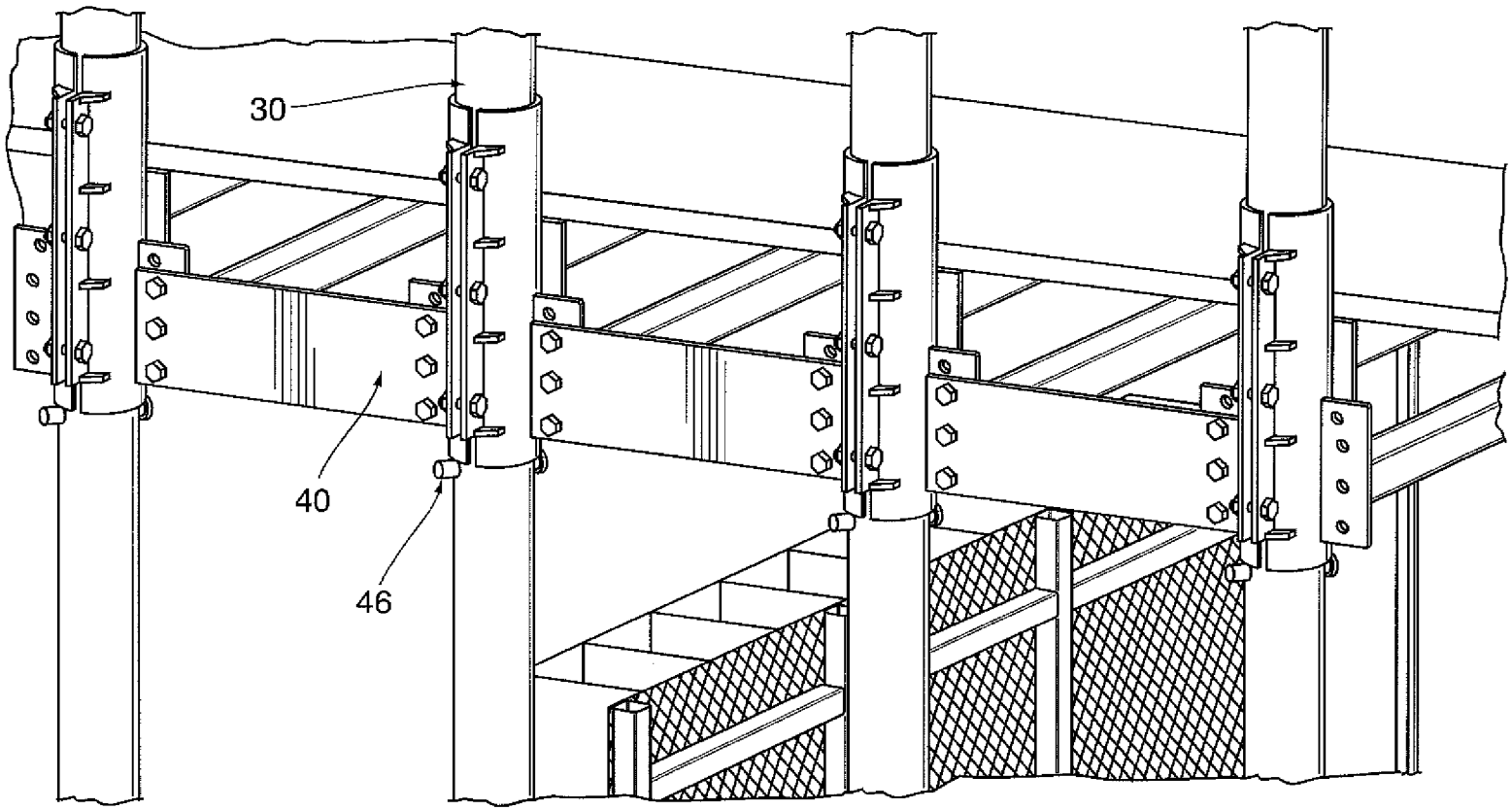
FIG. 15 is a perspective view of the coupling member slidingly engaged with corresponding stanchion members, according to embodiments of the present invention.
Figure 16A:
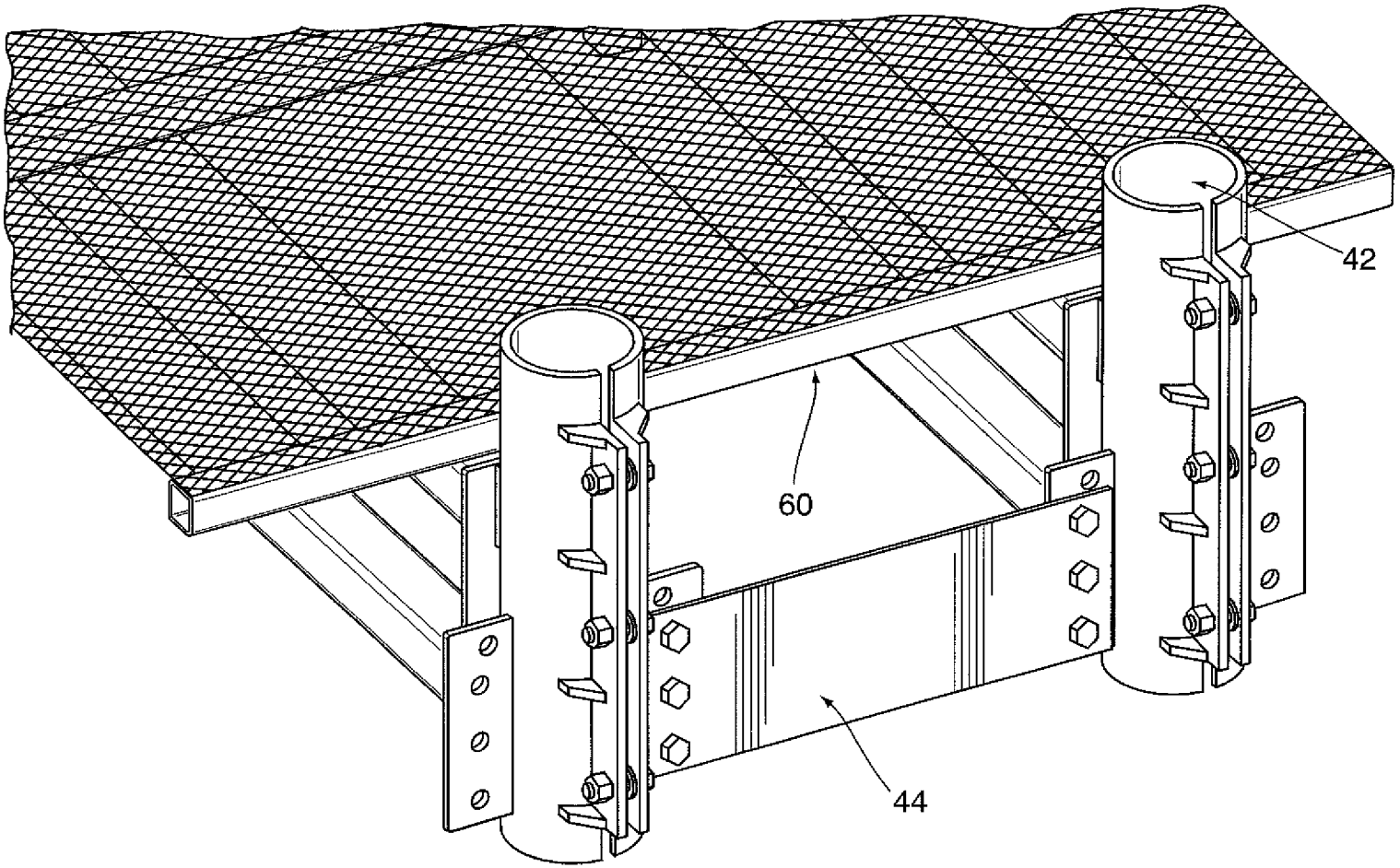
FIGS. 16 (*a*), (*b*), (*c*), (*d*), (*e*), (*f*), (*g*), and (*h*) are perspective, top, side and end views of the coupling member, according to embodiments of the present invention.
Figure 16B:
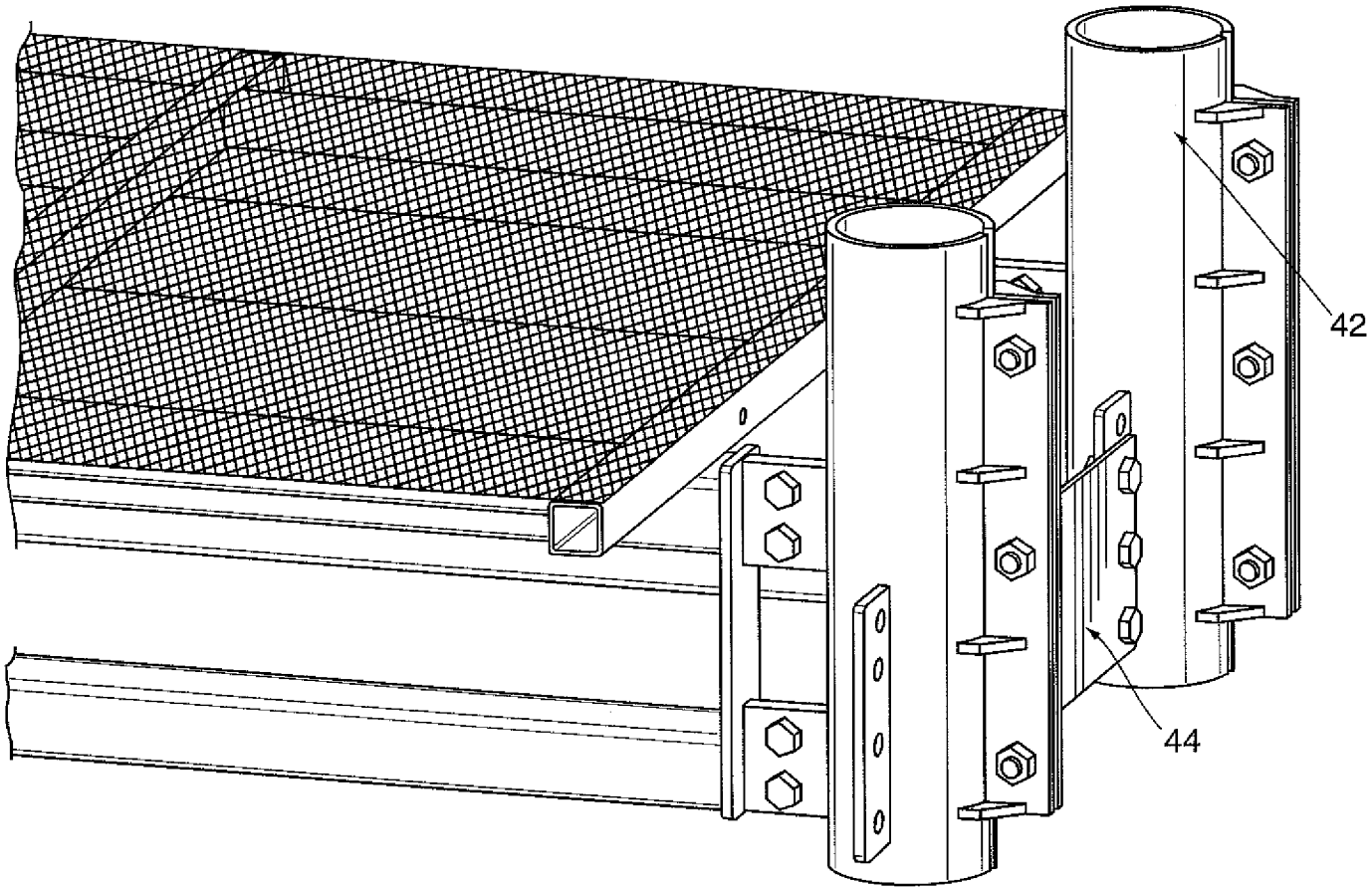
Figure 16C:
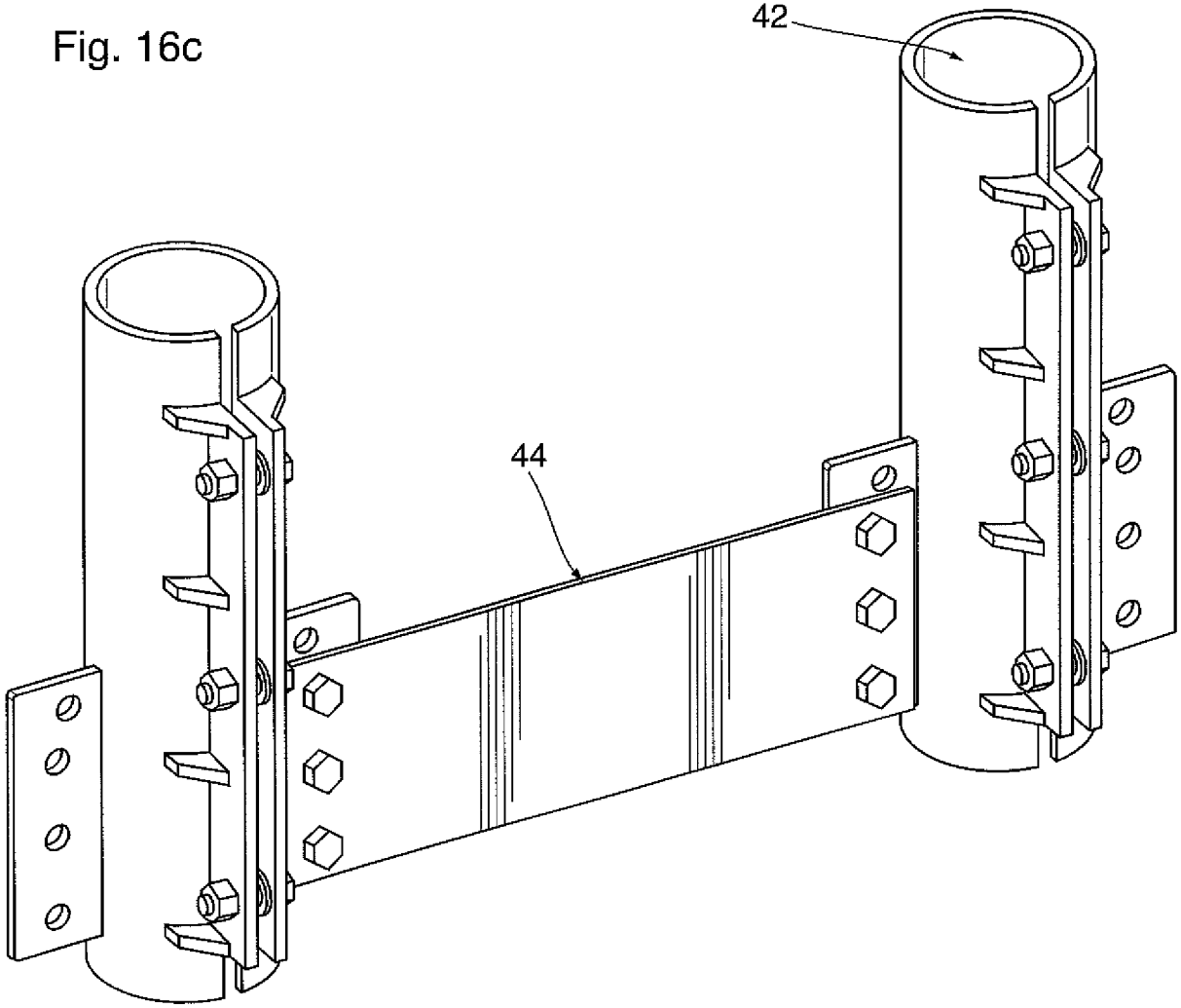
Figure 16D:
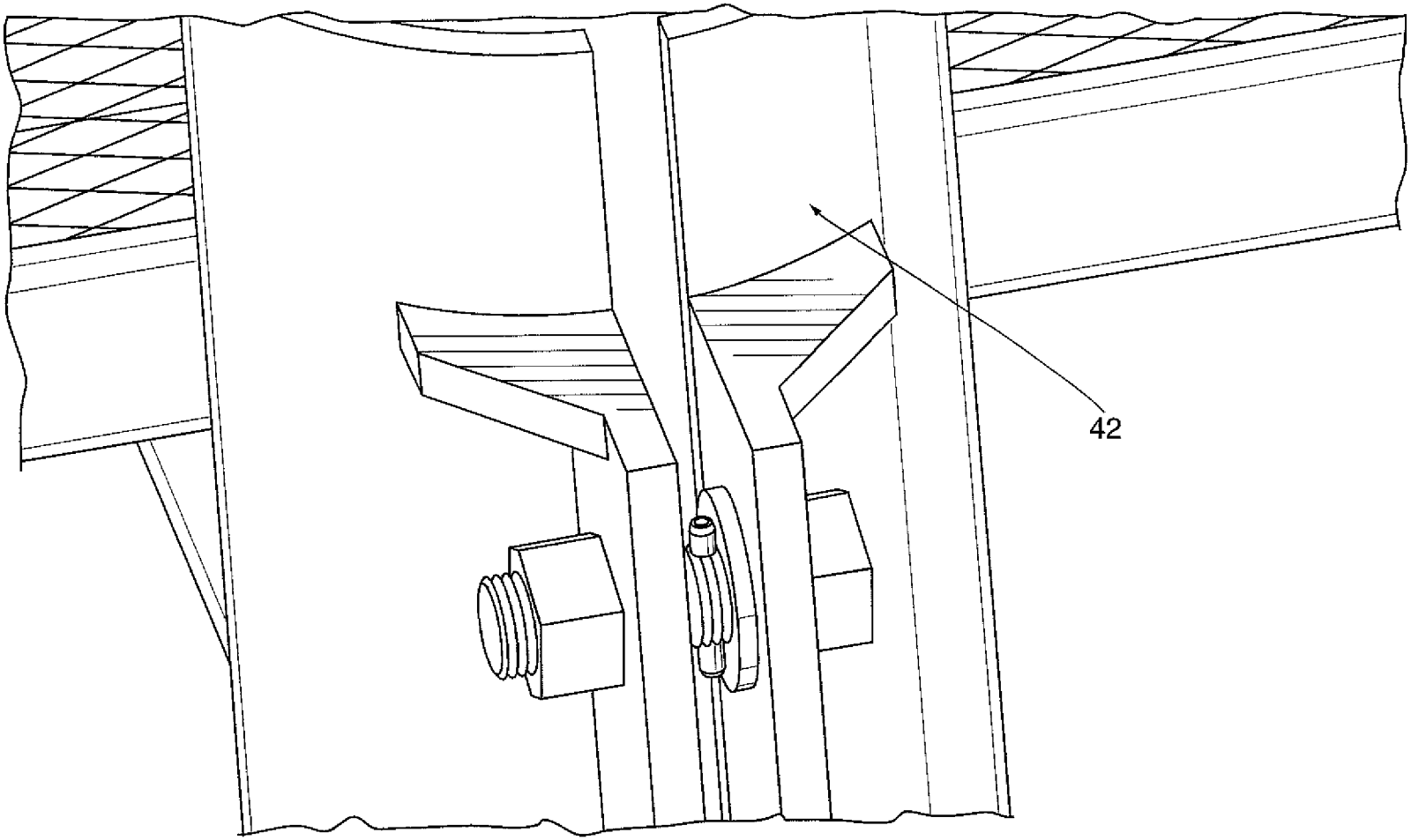
Figure 16F:
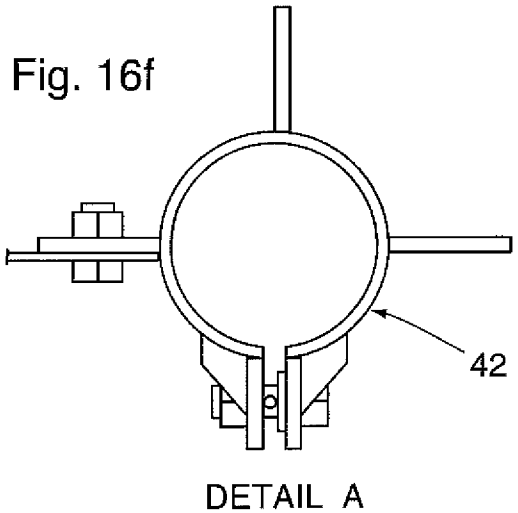
Figure 16H:
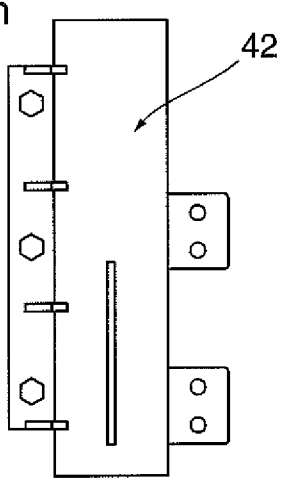
Figure 16E:
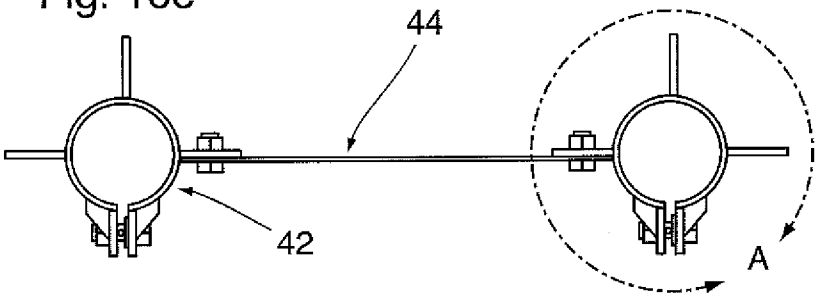
Figure 16G:
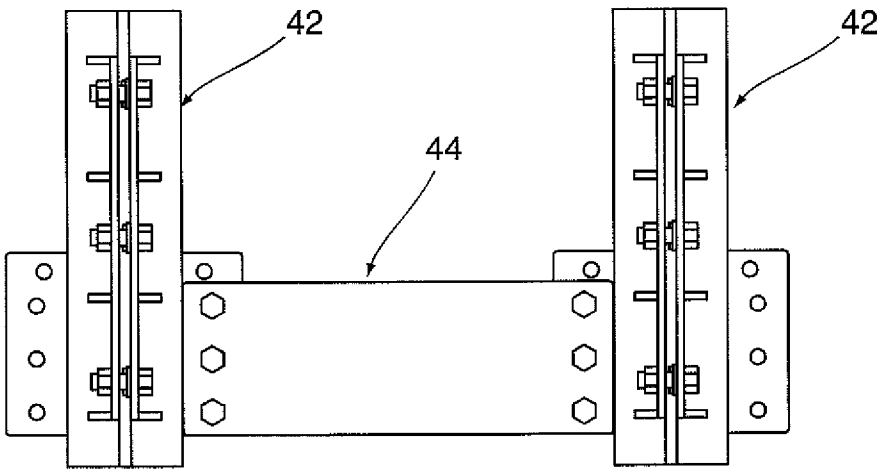

As illustrated in FIG. 15 coupling members 40 slidably couple the support frame 60 to a respective stanchion member 30. As shown in FIGS. 16 (*a-h*), the coupling member 40 comprises a slidable member 42 fixed to said support frame 60 and slidably engages with a corresponding stanchion member 30 to permit vertical positioning of said support frame 60 along the length of the supporting stanchion members 30. In some embodiments, the slidable member 42 is an adjustable clamp that can be locked and released to permit sliding along the length of the respective stanchion member 30 (FIG. 16(*d*)).

Figure 17A:
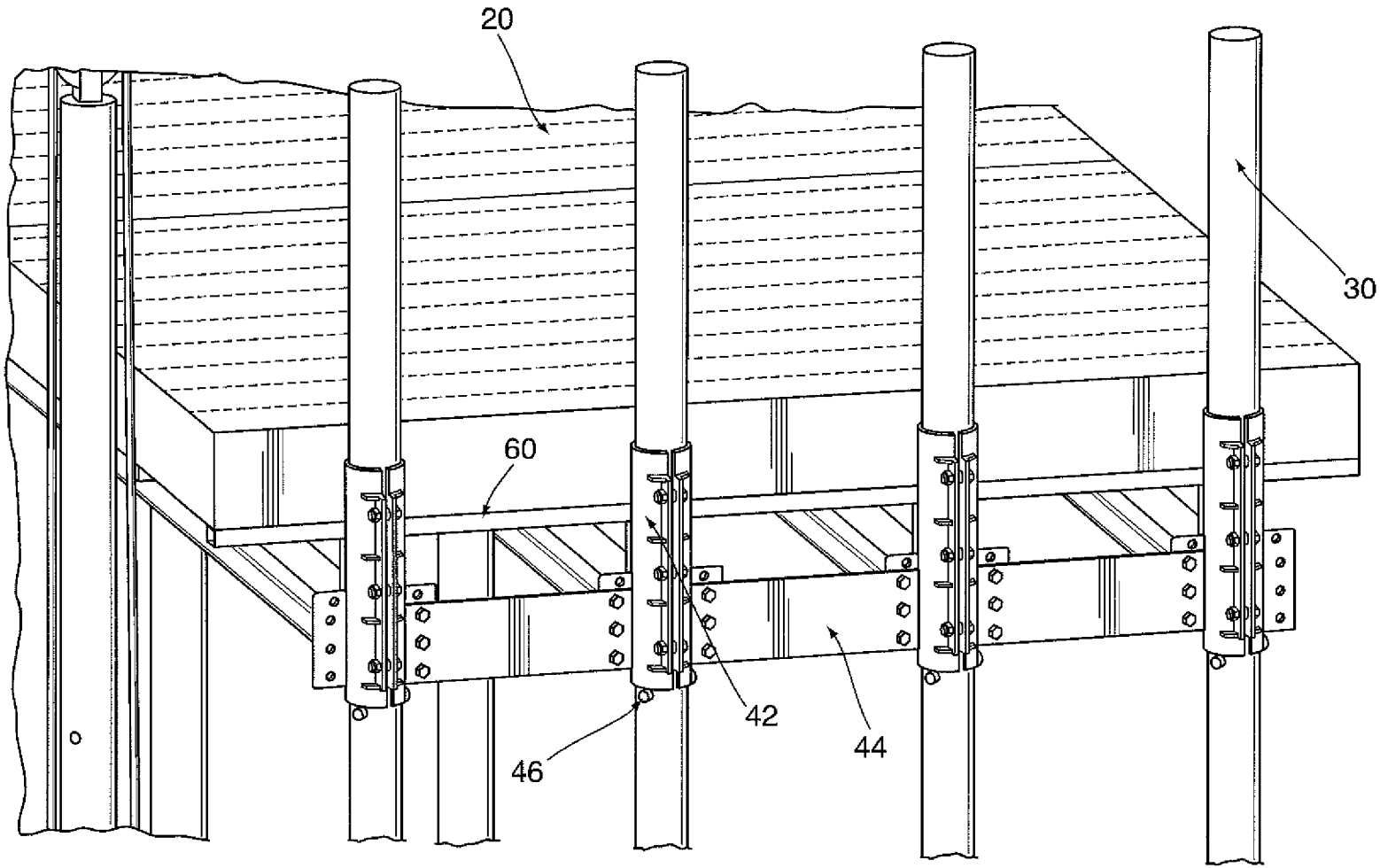
FIGS. 17 (*a*) and (*b*) are side and bottom perspective views of the assembled overhead cover in the raised position, according to embodiments of the present invention.
Figure 17B:
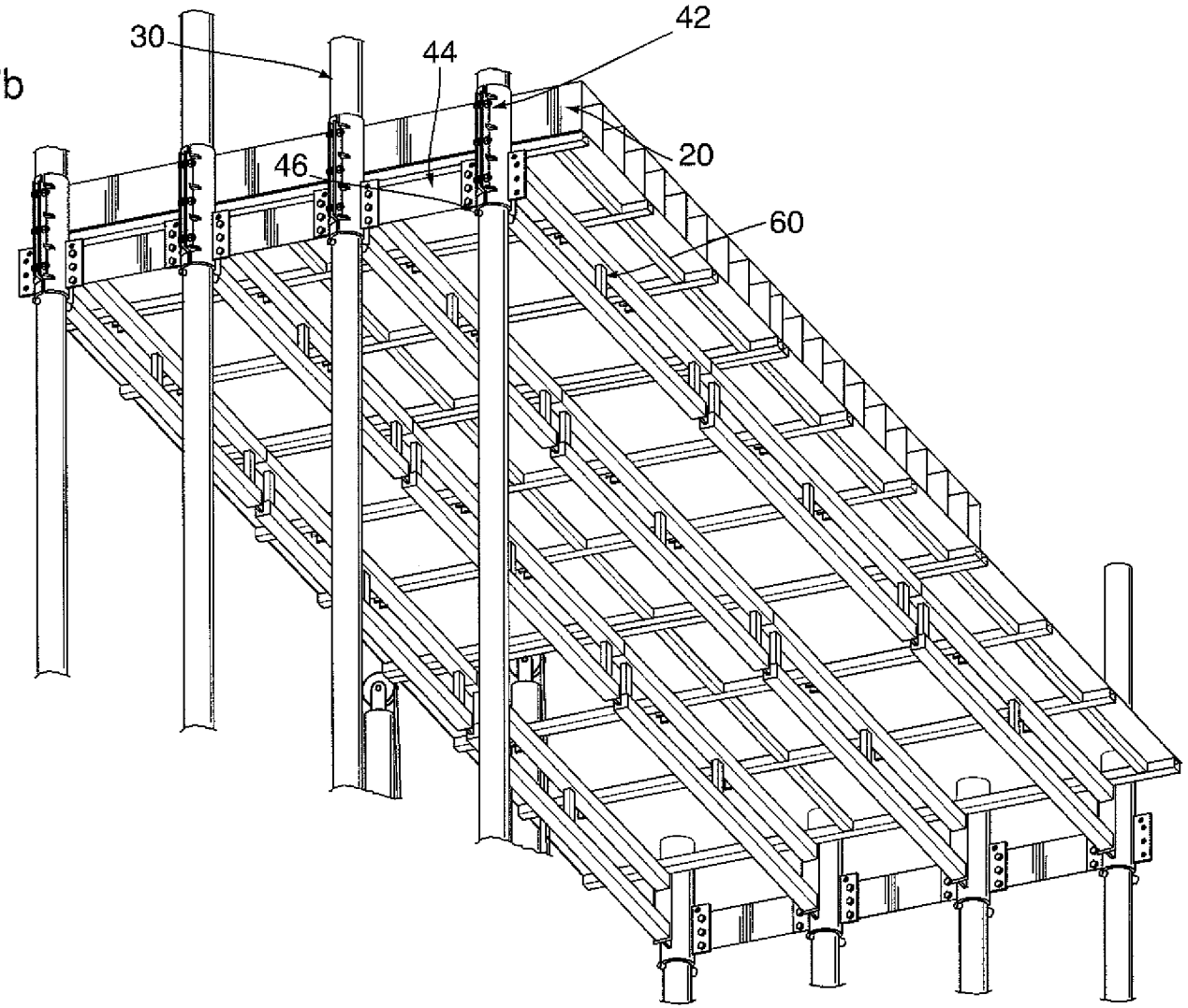

During assembly, the support frame 60 is in a lowered position relative to the supporting stanchion members 30 (FIGS. 1 (*a-c*)). Once the panel members 20 have been filled and pivoted to the horizontal position so as to overlay the support frame 60, the support frame 60 is lifted so as to slide along the vertical length of the stanchion members 30 until the desired vertical height is reached. Once in position (FIGS. 17 (*a-b*)), the slidable members 42 are clamped tight and locking pins 46 are inserted into the respective stanchion member 30 so as to lock the support frame 60 into place. In some embodiments, a web plate 44 is further connected between slidable members 42 on adjacent stanchion members 30 in order to provide additional support to the assembled protective building structure.

Figure 18A:
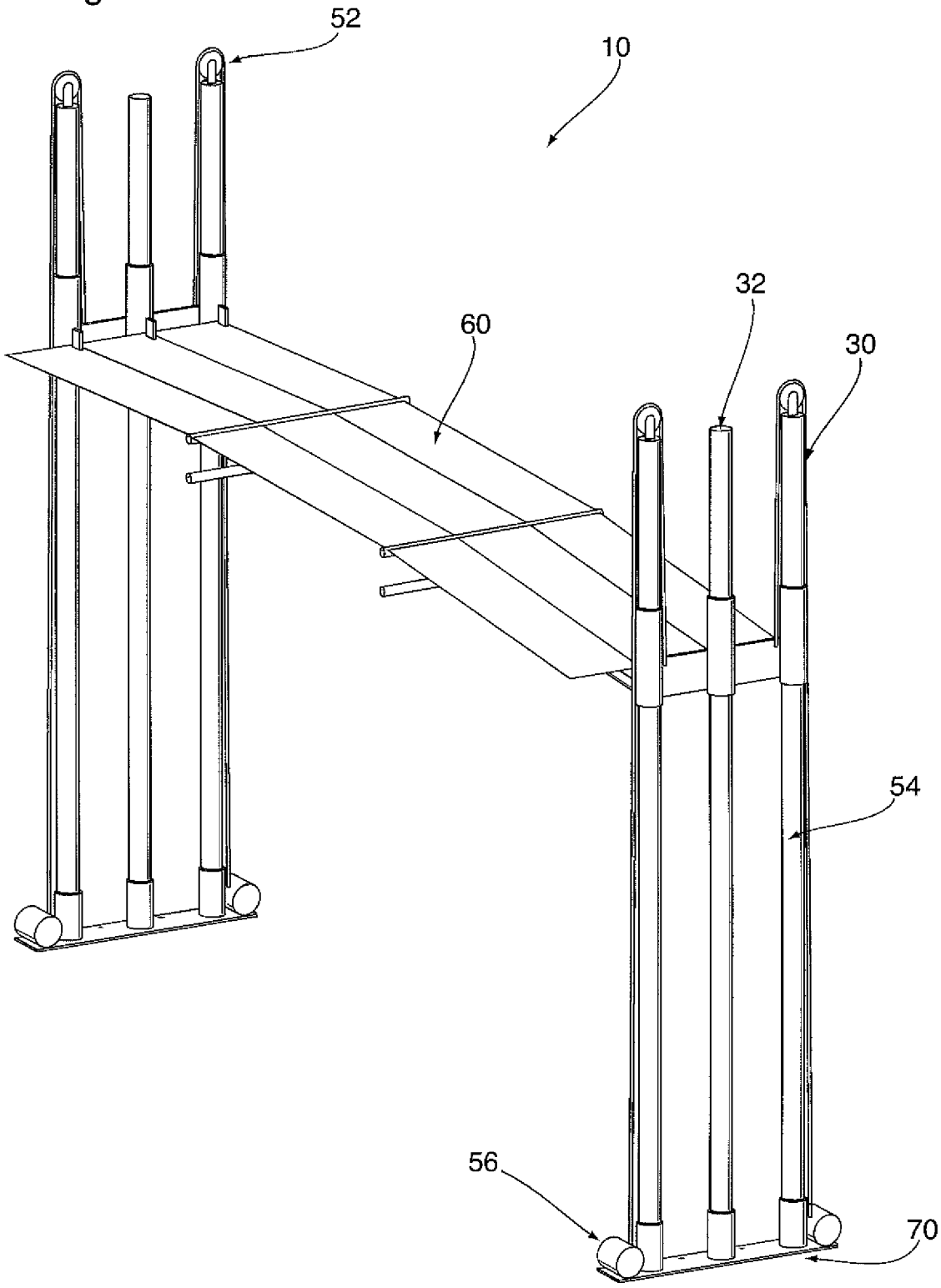
FIGS. 18 (*a*), (*b*), (*c*), (*d*) and (*e*) are perspective, side, top, front, and end views of an assembled kit, according to embodiments of the present invention.
Figure 18B:
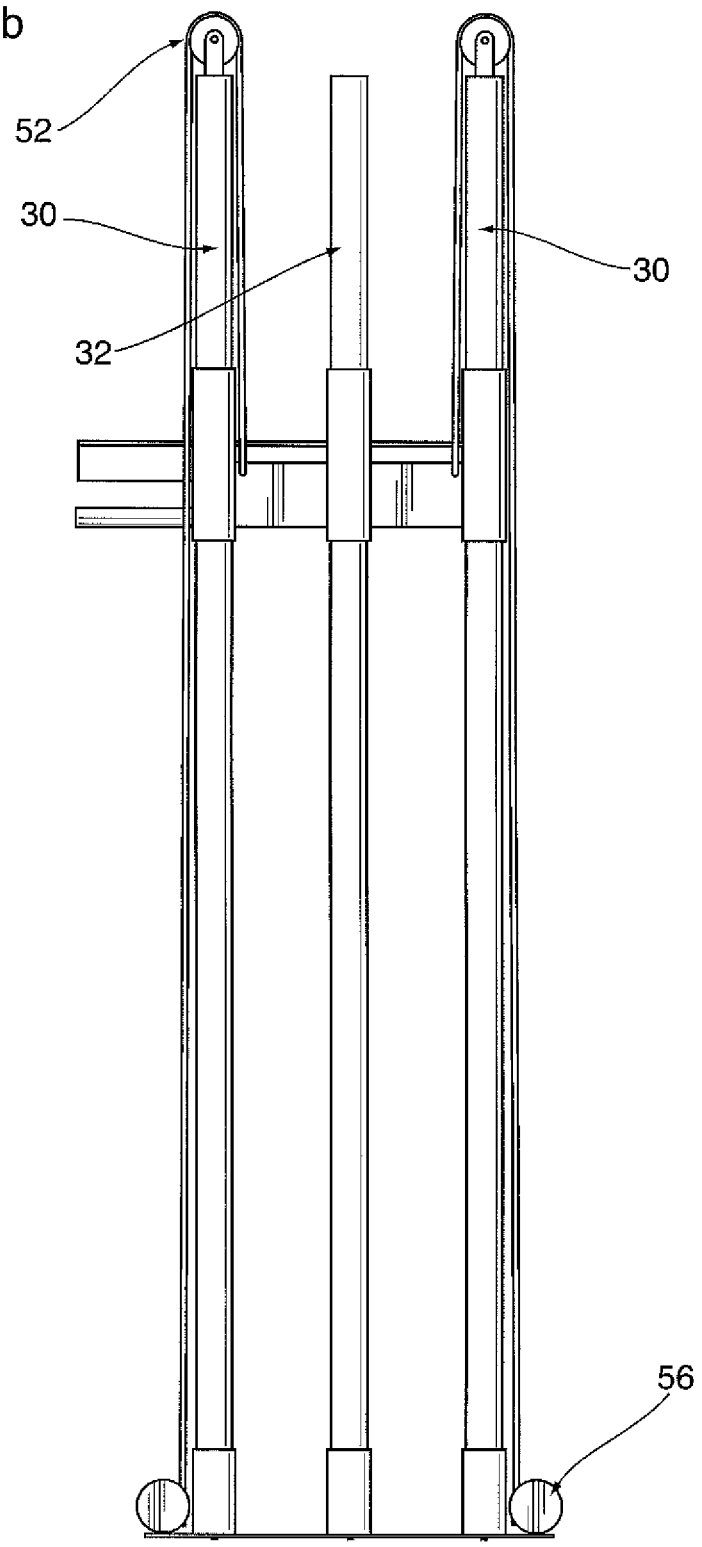
Figures 18C, 18D, 18E:
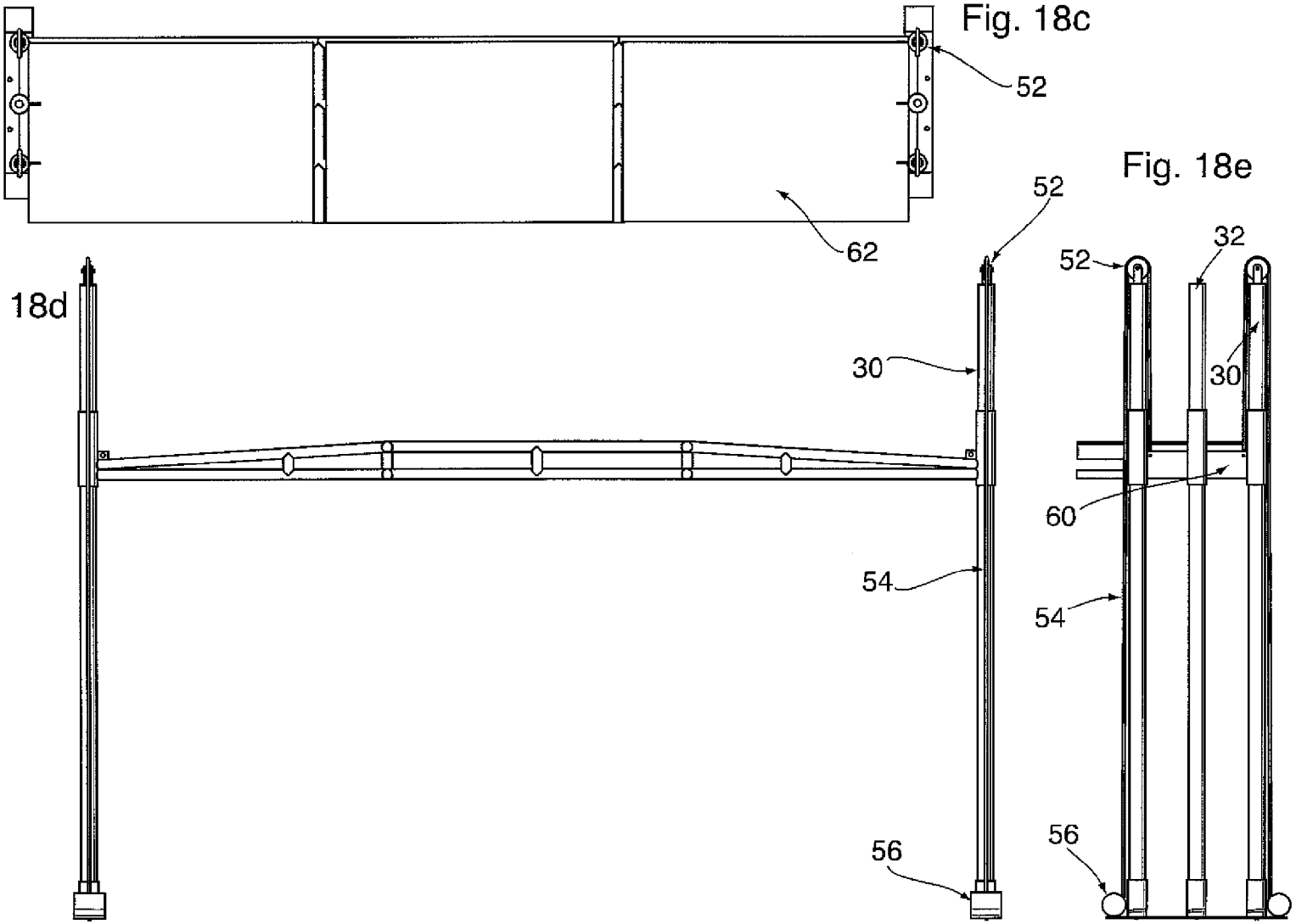
Figure 19:
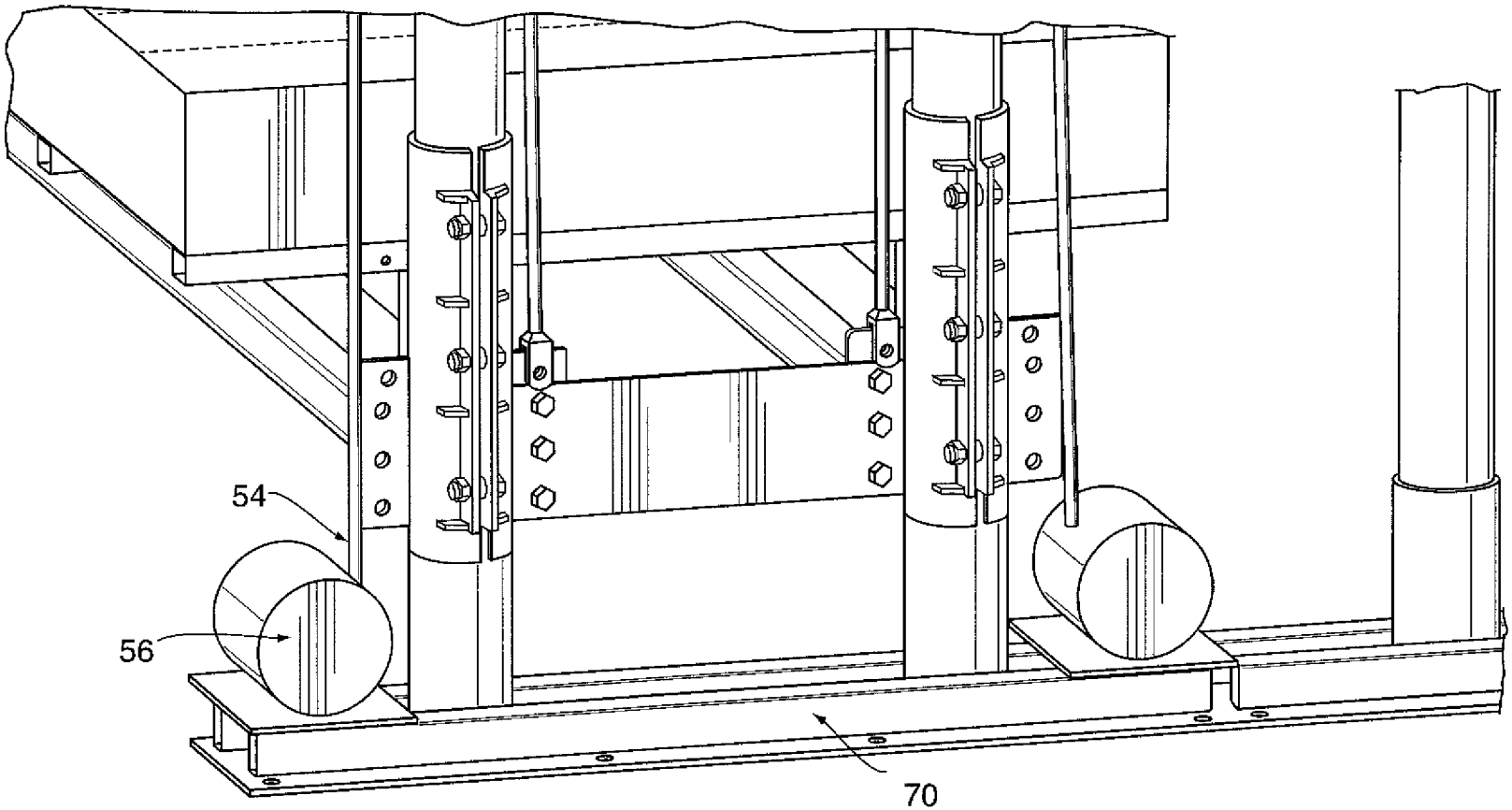
FIG. 19 is a perspective view of the pulley system, according to embodiments of the present invention.

Raising means for mechanically lifting the support frame 60 are included in the kit of the present invention. The self-raising mechanism comprises a pulley system positioned on a stanchion member 30 at each end of the support frame 60 to provide balanced application of force when vertically positioning the overhead cover 22. As illustrated in FIGS. 18(*a-e*), the pulley system comprises a wheel 52, an elongate cable 54 and a winch 56. The wheel 52 is fixed at the top end of the vertically oriented stanchion member 30 and the winch 56 is fixed at the opposite end of the stanchion member 30 between which the elongate cable is connected. As shown in FIG. 19, the pulley system is connected to the support frame 60 by one end of the elongate cable 54 and extends over the top end of the respective stanchion member 30 over the corresponding wheel 52 to connect at its other end to the winch 56 located at the bottom end of the stanchion member 30. Coordinated activation of the winch 56 at each end of the support frame 60 results in lifting of the support frame 60 upwards and sliding of the support frame 60 along the vertical length of the supporting stanchion members 30. In this way, the overhead cover 22 can be mechancially raised to the desired vertical position with minimal construction resources. The winch may be powered by an electric, hydraulic, pneumatic or internal combustion drive to mechanically winch the support frame 60 upward and/or downward along the respective stanchion member to the desired height. In a preferred embodiment, each stanchion member supporting a corner of the support frame 60 is fitted with a corresponding pulley system for coordinated lifting and/or lowering of the support frame 60. In this way, the overhead cover 22 can be vertically positioned anywhere along the length of the stanchion members 30.

FIGS. 18 (*a-e*) show embodiments of the present invention that include an additional center stanchion member 32 positioned between each of the corner stanchion members 30 in order to provide additional support to the assembled protection building structure. In such embodiments, the center stanchion member 32 is intended to carry load when in position, accordingly, the center stanchion member 32 does not require a corresponding pulley system.

Adjustable Base Plates—Slope Alignment

In some embodiments of the present invention, the kit includes adjustment means that allow the stanchion members 30 to be vertically aligned with varying gradients of a terrain. In this way, variations in the grade of the terrain can be accommodated without compromising the stability of the assembled protective building structure.

Figure 20A:
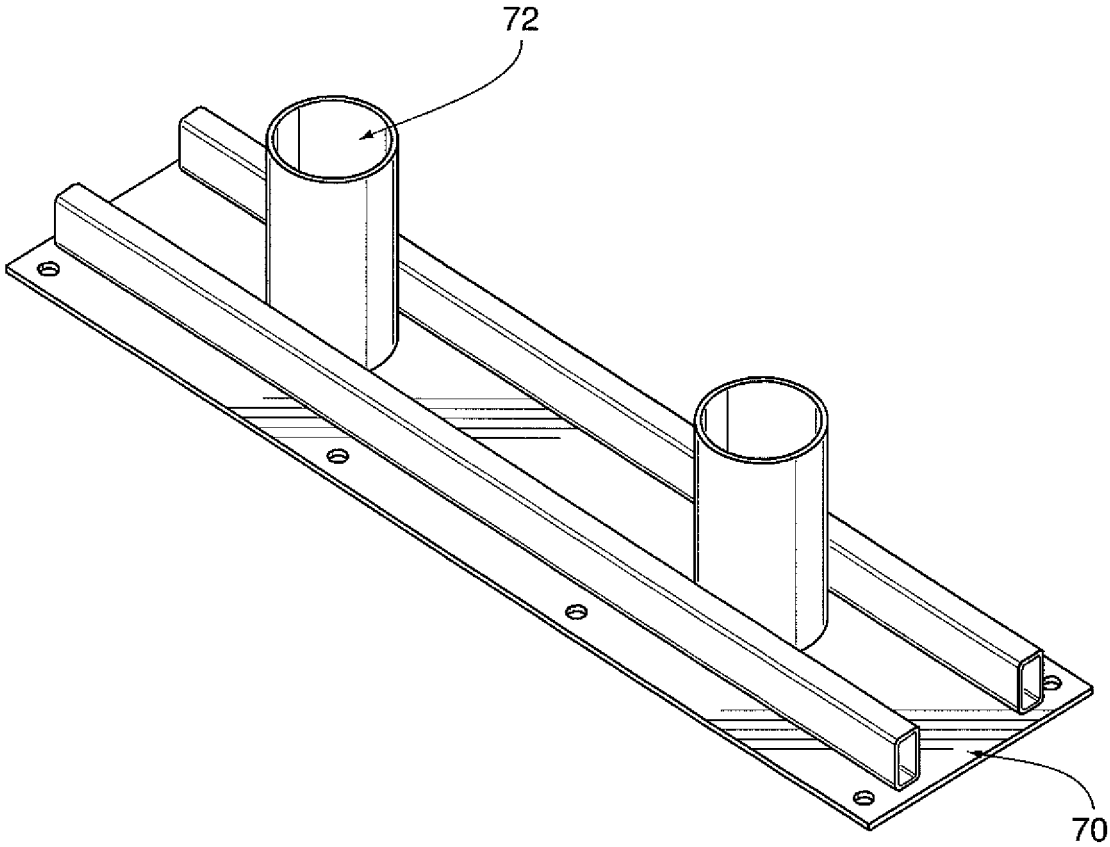
FIGS. 20 (*a*) and (*b*), are perspective views of the base plate, according to embodiments of the present invention.
Figure 20B:
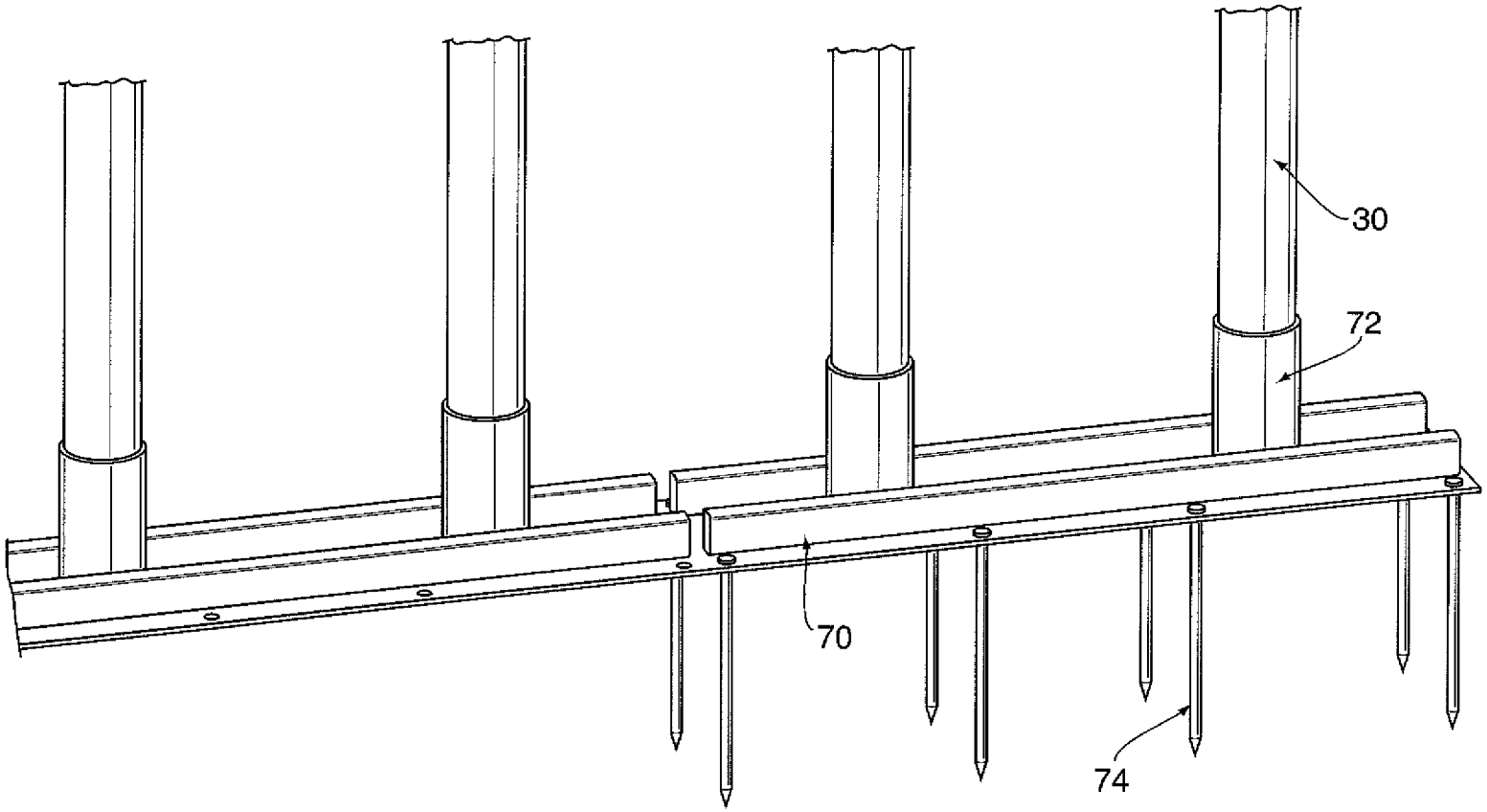

As shown in FIGS. 1 (*a-c*), the stanchion members 30 are vertically positioned at opposite ends of the support frame 60 by corresponding base plates 70. The base plates 70 provide lateral stability and positioning of the vertical stanchion members 30. Each base plate 70 comprises at least one base socket to receive a corresponding stanchion member 30. As illustrated in FIGS. 20 (*a-b*), preferred embodiments comprise two base sockets 72 in each base plate 70 that are laterally positioned on the base plate 70 to correspond with the width of the support frame 60 of the kit of the present invention. In this way, positioning of the stanchion members 70 with respect to the support frame 60 is predetermined and assembly is, thereby, facilitated. In some embodiments, the base plate 70 further comprises ground anchors 74 to set the lateral separation of the base plates 70 for alignment during assembly of the kit of the present invention.

Figure 23C:
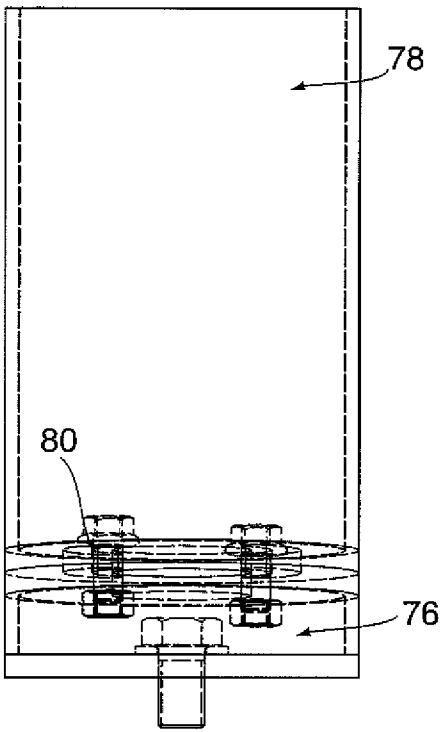
FIGS. 23 (*a*), (*b*) and (*c*), are top and side cross-sectional views of the base sockets, according to embodiments of the present invention.
Figure 23B:
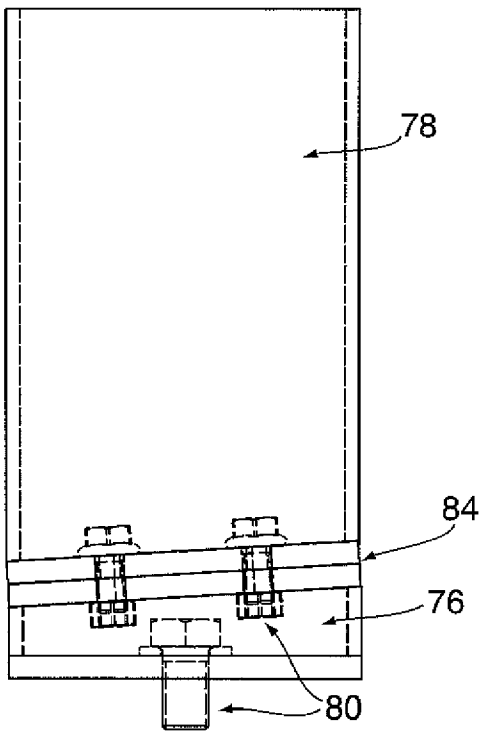
Figure 23A:
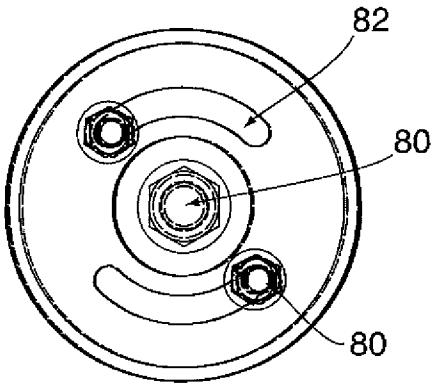
Figure 24B:
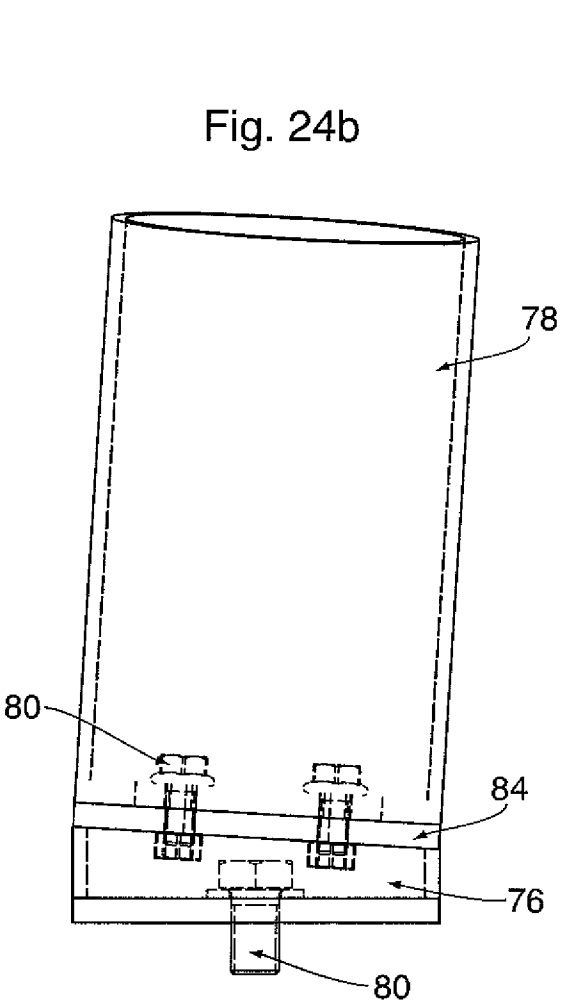
FIGS. 24 (*a*), (*b*) and (*c*), are top and side cross-sectional views of the base sockets, according to embodiments of the present invention.
Figure 24C:
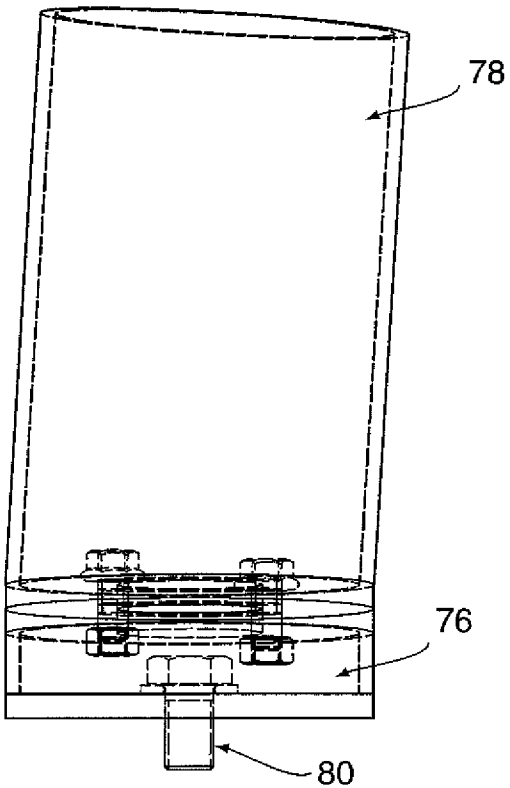
Figure 24A:
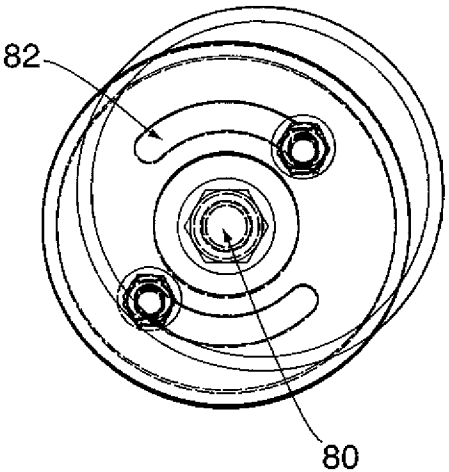

Some embodiments of the present invention comprise adjustable base plates 70 to accommodate for sloping grades in the terrain. In these embodiments, as shown in FIGS. 21 (*b-c*) and FIGS. 22 (*a* and *c*), the base socket 72 comprises two rotating assemblies, a lower assembly 76 that is releasably connected to the base plate 70 and an upper assembly 78 that is releasably connected to the lower assembly 76. As shown in FIG. 23 (*b*) and FIG. 24 (*b*), the two assemblies comprise surfaces 84 that mate at an angle above horizontal. FIGS. 23 and 24, illustrate the result of relative rotation of the two assemblies according to embodiments of the invention. The assemblies 76, 78 are adapted to be rotatable with respect to each other such that when the two assemblies 76, 78 are rotated, the vertical orientation of the base socket 72 is displaced (FIG. 24). In this way, the vertical orientation of the base socket 72, and the corresponding stanchion member 30 inserted in the base socket 72, can be adjusted by rotating the assemblies 76, 78 until the desired vertical orientation is achieved. Accordingly, vertical orientation of the stanchion members 30 even on sloping terrain can be achieved by compensating for any sloping gradient. Once the assemblies 76, 78 are rotated to achieve vertical orientation from any base plate slope, the assemblies 76, 78 are locked into place by tightening of the locking bolts 80 inside the assemblies 76, 78. Rotation of the entire base socket 72 relative to the base plate 70 allows slopes in any direction of the base plate 70 to be accommodated.

Figure 22A:
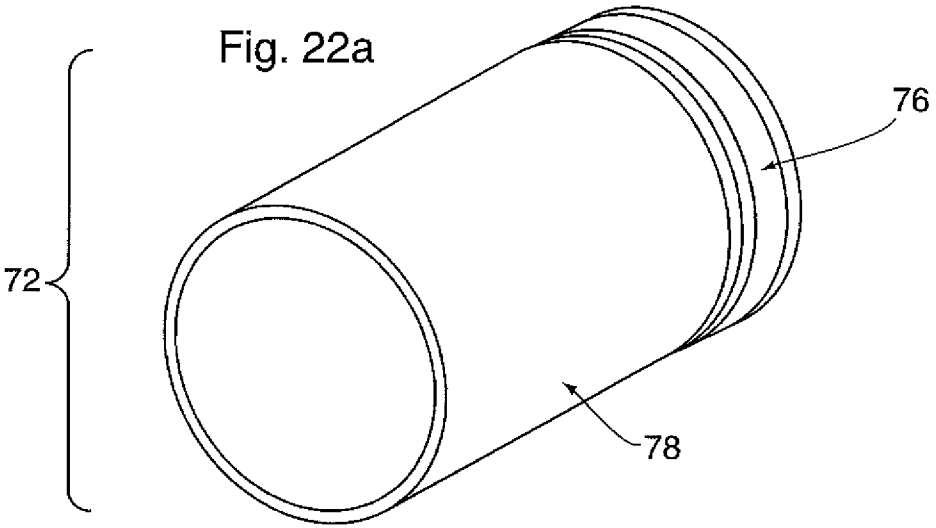
FIGS. 22 (*a*), (*b*) and (*c*), are side perspective, top and side cross-sectional views of the base sockets, according to embodiments of the present invention.
Figure 22C:
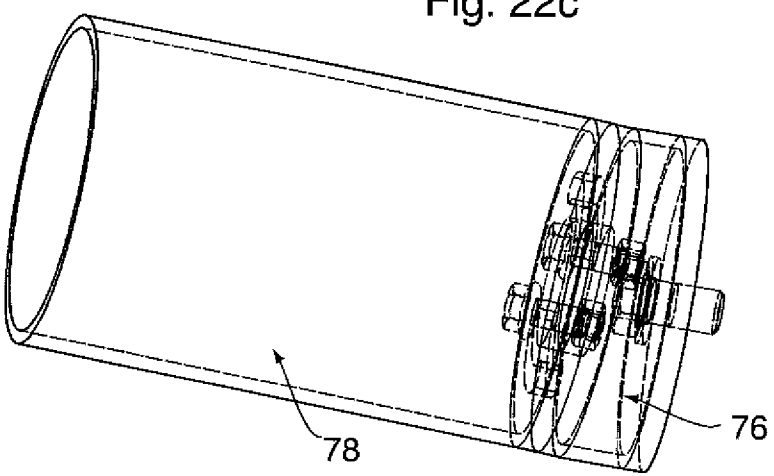
Figure 22B:
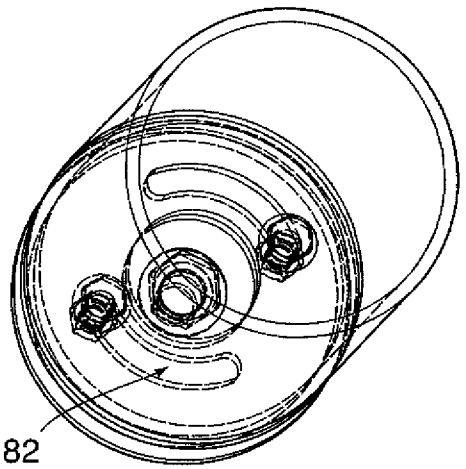
Figure 25A:
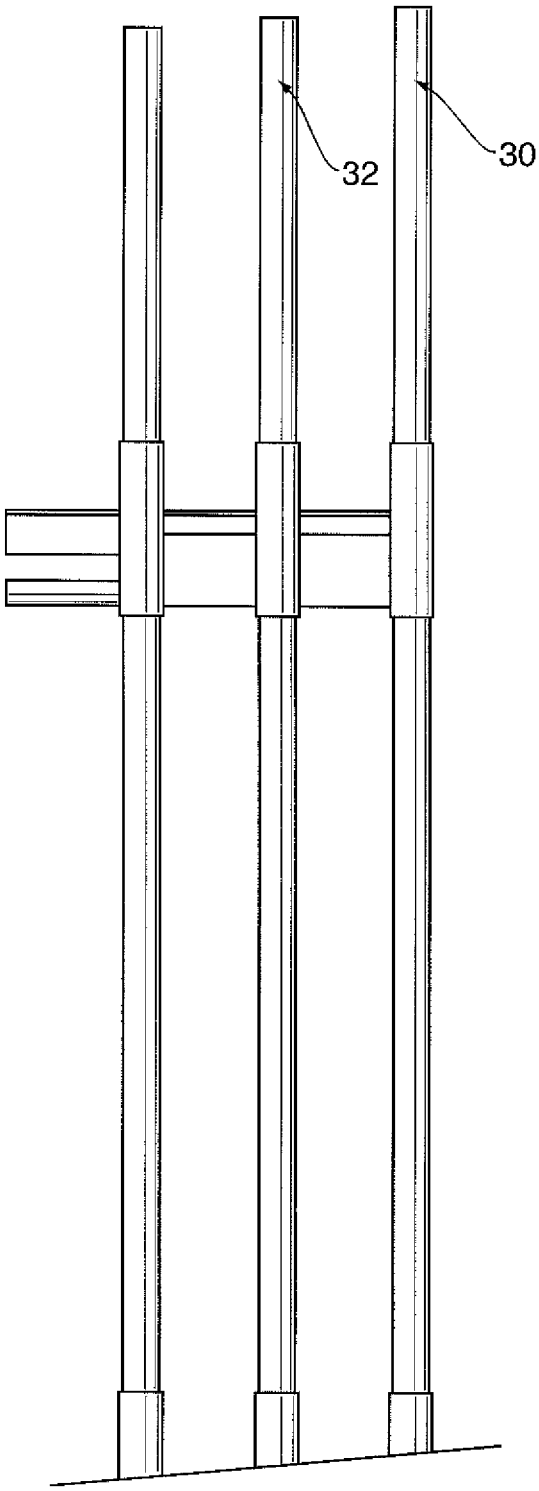
FIGS. 25 (*a*) and (*b*) are side perspective, top, front, and side views of an assembled kit, according to embodiments of the present invention.
Figure 25B:
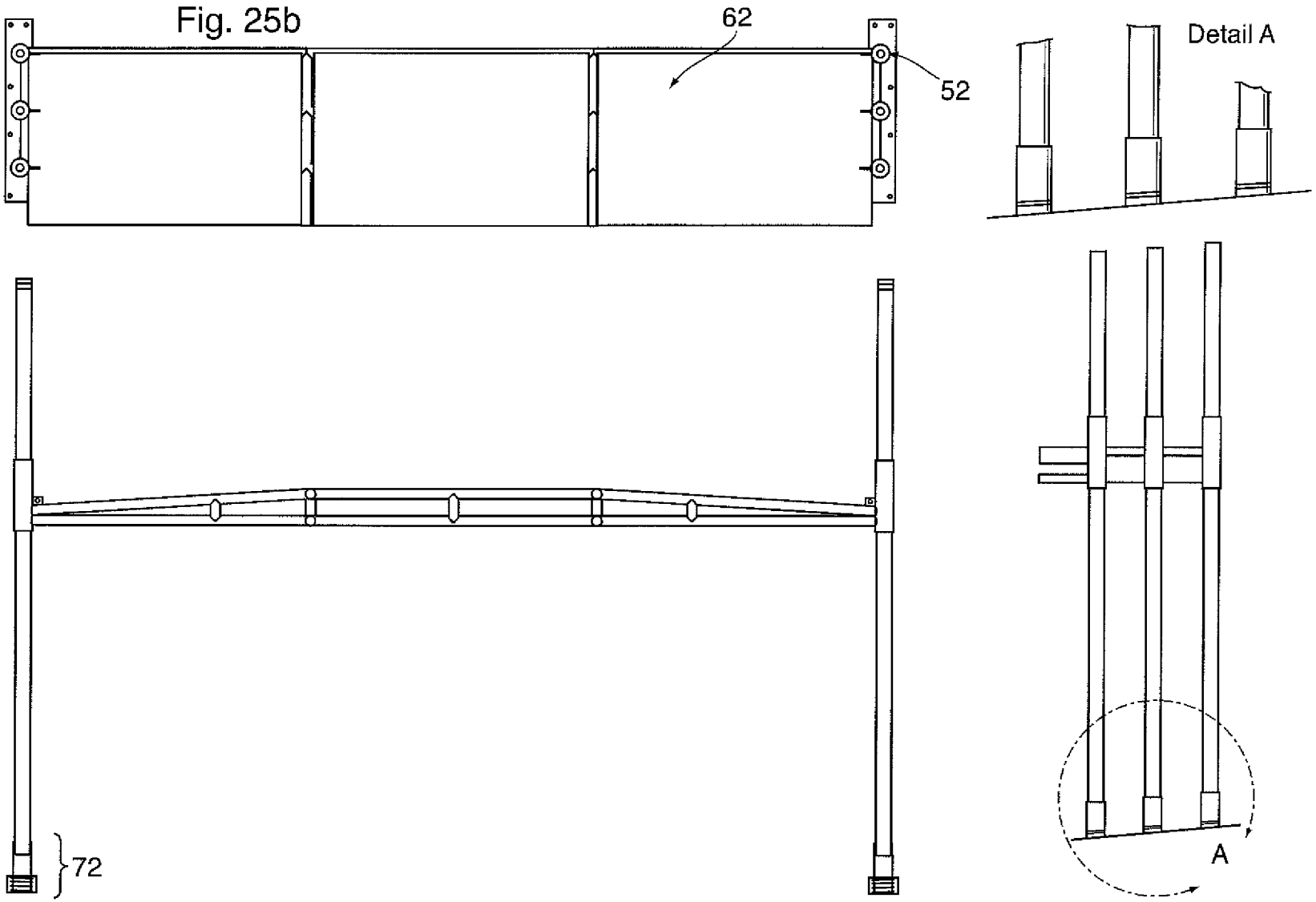

As shown in FIGS. 22(*c*), 23(*b-c*) and 24(*b-c*), the assemblies 76, 78 are releasably connected to each other by locking bolts 80 inside the assemblies. During assembly, the locking bolts 80 cooperate with guiding slots 82 (FIGS. 21(*a*), 23(*a*) and 24(*a*)) in the mating surfaces of the lower 76 and upper 78 assembly to guide and provide controlled rotation of the assemblies 76, 78. In a preferred embodiment, the lower 76 and upper 78 assemblies comprise guiding slots that permit rotation within 90 degrees of each other, and mate at a surface 3.5 degrees from horizontal to permit any angle from vertical between horizontal up to 6 pct to be accommodated. As a result, vertical orientation of stanchion members 30 relative to a sloping grade having an angle from vertical between horizontal up to 6 pet can be achieved (FIGS. 25 (*a-b*)). Embodiments of the present invention further allow slopes up to 6 pet cross slope to be accommodated due to the rotatability of the entire base socket 72 relative to the base plate 70. In other embodiments, as shown in FIGS. 21(*b*), grades that differ relative to each other can further be accommodated by rotationally adjusting each individual base socket 72 accordingly. In this way, the stanchion members 30 can be vertically oriented on uneven terrain simply by rotatably adjusting the individual base sockets 72 to the varying slope.

Modular Assembly—Compact Packing

The modular nature of the kit of the present invention provides versatile options for assembling protective building structures of a variety of sizes. FIG. 12 illustrates a single unit of an assembled protective building structure (overhead cover not shown) according to embodiments of the present invention. A plurality of single units may be joined together to form protective building structures of any size to suit. For example, FIGS. 1 (*a-c*) show the assembly of a protective building structure comprising three single units joined together.

Figure 26A:
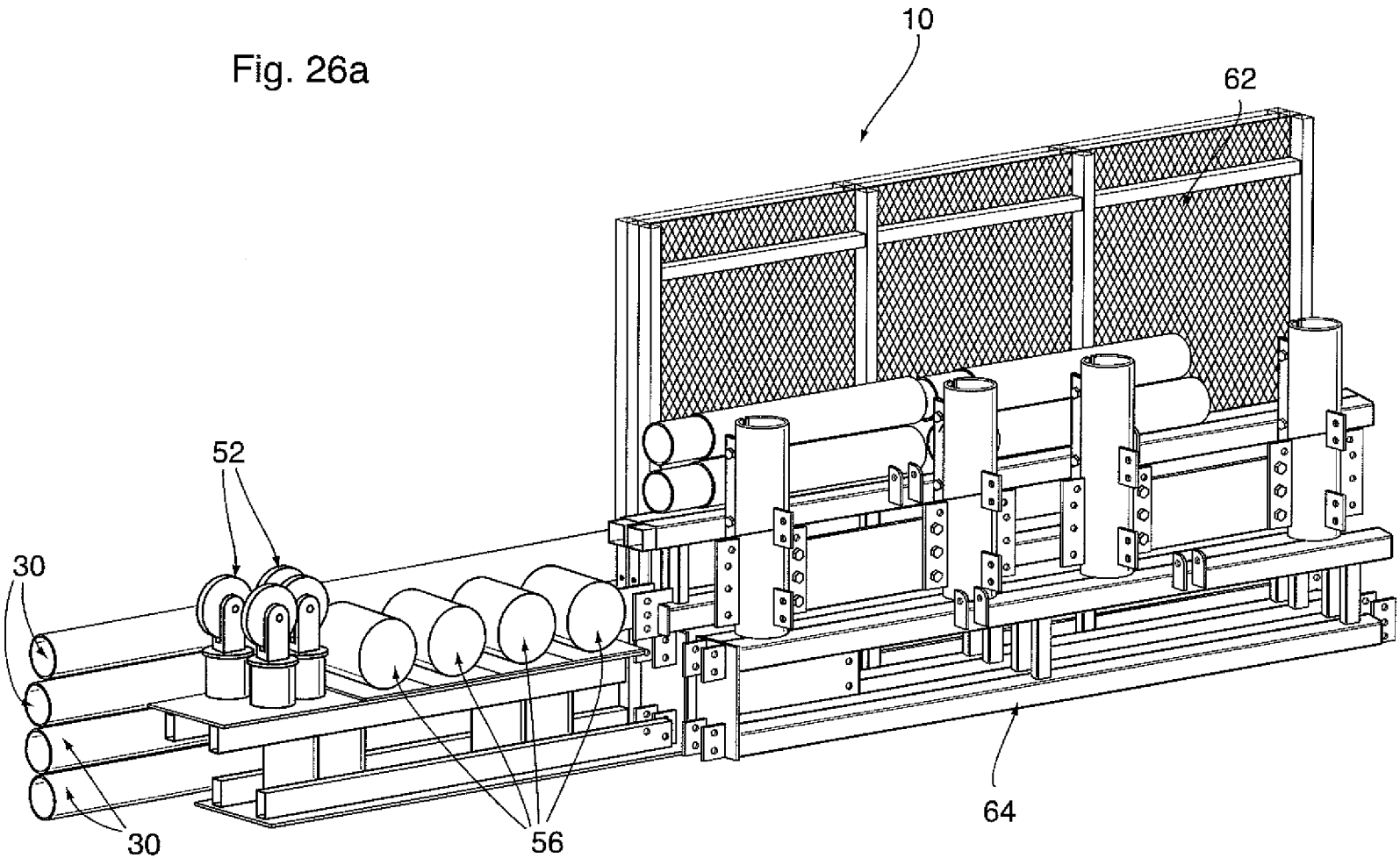
FIGS. 26 (*a*) and (*b*), are perspective, side, and end views of a packaged kit, according to embodiments of the present invention.
Figure 26B:
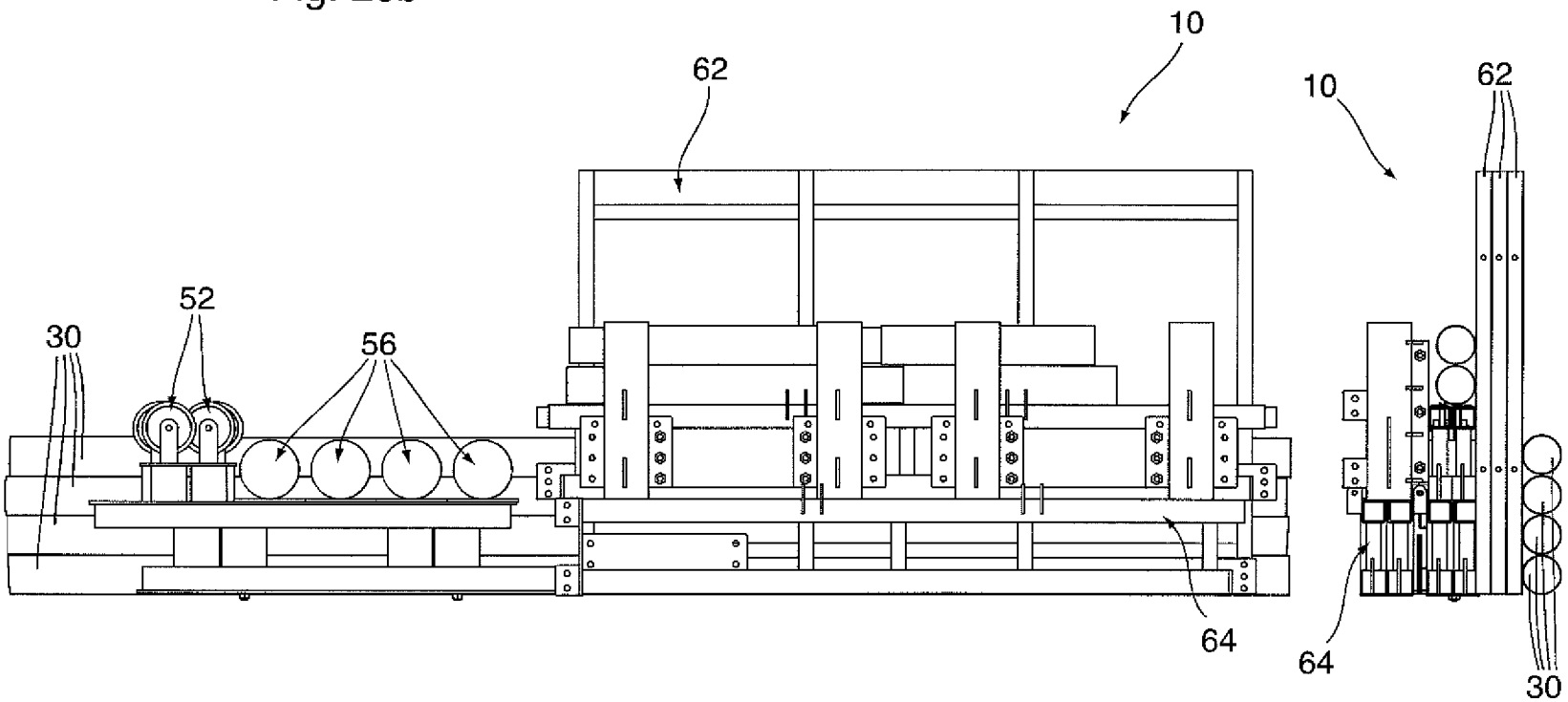

The modular nature of the kit further allows for compact packaging of the kit in a variety of combinations. FIGS. 26 (*a-b*) illustrate one embodiment of a pack up for a single unit. In other embodiments, a kit can include three single units packaged into a conex box measuring, for example, 2.4 meters×2.4 meters×6 meters. Due to the versatility provided by the modular nature of the kit of the present invention, packing, delivering, and assembling protective building structures in unpredictable environments is facilitated.

Although the invention has been described with reference to certain specific embodiments, various modifications thereof will be apparent to those skilled in the art without departing from the spirit and scope of the invention. All such modifications as would be apparent to one skilled in the art are intended to be included within the scope of the following claims.

The embodiments of the invention in which an exclusive property or privilege is claimed are defined as follows:

1. A kit for assembling a protective building structure, wherein said building structure is resistant to and protects occupants from overhead ordinance detonations, comprising:

at least one support frame;

a plurality of individual rectangular prismatic panel members, each having one end through which fill material may be placed and the panel member filled with such fill material, each of said panel members pivotably couplable to said at least one support frame, and pivotable from a vertical position where said fill material may be inserted in said panel member, to a horizontal position overlying said support frame;

a plurality of elongate stanchion members, adapted, when positioned in a vertical position, at opposite ends of said support frame, to support said support frame and said panel members thereon;

a plurality of coupling members, coupling said support frame to a respective of said stanchion members, said coupling members variably positionable along a respective stanchion member, further permitting fixed location of said support frame at a desired vertical height along a respective stanchion member; and raising means, for mechanically raising said support frame vertically while coupled to said stanchion members to a desired vertical height along said stanchion members.

2. The kit for assembling a protective building structure as claimed in claim 1, wherein said raising means comprises a pulley system, said pulley system comprising a wheel, elongate cable, and winch means for mechanically winching said support frame upward along said stanchions to a desired height.

3. The kit for assembling a protective building structure as claimed in claim 2, wherein said winch means is powered by an electric, hydraulic, pneumatic or internal combustion drive.

4. The kit for assembling a protective building structure as claimed in claim 1 or 2, wherein said support frame comprises a truss assembly and at least one support platform hingably connected to said truss assembly, wherein said support platform provides structural support for said plurality of panel members to allow pivoting between said vertical position and said horizontal position.

5. The kit for assembling a protective building structure as claimed in claim 1 or 2, wherein said plurality of stanchion members comprises a plurality of corresponding base plates to position said stanchion members at opposite ends of said support frame.

6. The kit for assembling a protective building structure as claimed in claim 5, wherein each said base plates comprises a plurality of anchoring means to anchor said stanchion members into position.

7. The kit for assembling a protective building structure as claimed in claim 5, wherein each of said base plates comprises a plurality of base sockets to receive said plurality of stanchion members in said vertical position.

8. The kit for assembling a protective building structure as claimed in claim 7, wherein each of said base sockets comprises two rotating assemblies, a lower assembly releasably connected to said base plate and an upper assembly releasably connected to said lower assembly, said lower and upper assemblies adapted such that relative rotation within 90 degrees of each other achieves vertical orientation of said corresponding stanchion member from a sloping grade.

9. The kit for assembling a protective building structure as claimed in claim 8, wherein said rotating assemblies are adapted such that said assemblies mate at a surface 3.5 degrees from horizontal.

10. The kit for assembling a protective building structure as claimed in claim 8, wherein relative rotation of said rotating assemblies allows vertical orientation of said corresponding stanchion member relative to said sloping grade having an angle from vertical between horizontal to 6 pct.

11. The kit for assembling a protective building structure as claimed in claim 8, wherein said lower assembly is rotatable relative to said base plate to achieve variable vertical positioning of said corresponding stanchion member relative to said sloping grade.

12. The kit for assembling a protective building structure as claimed in claim 8, wherein each said base sockets further comprise locking bolts to fix said rotating assemblies in a desired position relative to said ground slope.

13. The kit for assembling a protective building structure as claimed in claim 1 or 2, wherein said panel members are constructed of a ballistic material.

14. The kit for assembling a protective building structure as claimed in claim 1 or 2, wherein said panel members each comprise a plurality of cells formed by internal partitions extending through said panel member, said partitions adapted to provide rigidity to said panel member prior to filling.

15. The kit for assembling a protective building structure as claimed in claim 1 or 2, wherein said panel members are adapted for filling to a sufficient thickness to resist and protect occupants from overhead ordinance detonations.

16. The kit for assembling a protective building structure as claimed in any one of claim 1 or 2, wherein said panel members are filled to a thickness of at least one foot thick.

17. The kit for assembling a protective building structure as claimed in claim 1 or 2, wherein each of said stanchion members comprise a plurality of segments that fittingly engage to form a final length.

18. The kit for assembling a protective building structure as claimed in claim 1 or 2, wherein each of said plurality of coupling members comprise a slidable member fixed to said support frame and slidably engaged with a respective stanchion member to allow vertical positioning of said support frame along said stanchion member.

19. The kit for assembling a protective building structure as claimed in claim 1 or 2, wherein said plurality of coupling members further comprise a web plate connecting said adjacent slidable members.

20. The kit for assembling a protective building structure as claimed in claim 1 or 2, wherein each of said plurality of coupling members further comprises a locking pin that cooperatively engages with said respective stanchion member to prevent sliding of said sliding member along said respective stanchion and thereby fixing said support frame at the desired vertical height along said respective stanchion member.

21. The kit for assembling a protective building structure as claimed in claim 1 or 2, wherein all components of said kit are pre-packaged in a standard conex box for delivery to a field location for assembly.

22. A kit for assembling a protective building structure, wherein said building structure is resistant to and protects occupants from overhead ordinance detonations, comprising:

at least one support frame;

a plurality of individual rectangular prismatic panel members, each having one end through which fill material may be placed and the panel member filled with such fill material, each of said panel members pivotably couplable to said at least one support frame, and pivotable from a vertical position where said fill material may be inserted in said panel member, to a horizontal position overlying said support frame;

a plurality of elongate stanchion members, adapted, when positioned in a vertical position, at opposite ends of said support frame, to support said support frame and said panel members thereon;

a plurality of coupling members, coupling said support frame to a respective of said stanchion members, said coupling members variably positionable along a respective stanchion member, further permitting fixed location of said support frame at a desired vertical height along a respective stanchion member;

raising means, for mechanically raising said support frame vertically while coupled to said stanchion members to a desired vertical height along said stanchion members; and a container for packing said kit for delivery to a field location for assembly.

23. A kit for assembling a protective building structure, wherein said building structure is resistant to and protects occupants from overhead ordinance detonations, comprising:

at least one support frame;

a plurality of individual rectangular prismatic panel members, each having one end through which fill material may be placed and the panel member filled with such fill material, each of said panel members pivotably couplable to said at least one support frame, and pivotable from a vertical position where said fill material may be inserted in said panel member, to a horizontal position overlying said support frame;

a plurality of elongate stanchion members, adapted, when positioned in a vertical position, at opposite ends of said support frame, to support said support frame and said panel members thereon;

a plurality of base plates configured to receive said stanchion members and position said stanchion members at opposite ends of said support frame, each of said plurality of base plates adapted to adjust orientation of said corresponding stanchion member in said vertical position relative to a sloping grade;

a plurality of coupling members, coupling said support frame to a respective of said stanchion members, said coupling members variably positionable along a respective stanchion member, further permitting fixed location of said support frame at a desired vertical height along a respective stanchion member; and raising means, for mechanically raising said support frame vertically while coupled to said stanchion members to a desired vertical height along said stanchion members.

24. The kit for assembling a protective building structure as claimed in claim 23, wherein said base plate comprises a plurality of base sockets to receive said plurality of stanchion members in said vertical position.

25. The kit for assembling a protective building structure as claimed in claim 24, wherein said base socket comprises two rotating assemblies, a lower assembly releasably connected to said base plate and an upper assembly releasably connected to said lower assembly, said lower and upper assemblies adapted such that relative rotation within 90 degrees of each other achieves vertical orientation of said corresponding stanchion member from said sloping grade.

26. The kit for assembling a protective building structure as claimed in claim 25, wherein said rotating assemblies are adapted such that said assemblies mate at a surface 3.5 degrees from horizontal.

27. The kit for assembling a protective building structure as claimed in claim 25, wherein relative rotation of said rotating assemblies achieves vertical orientation from said sloping grade, said sloping grade having an angle from vertical between horizontal to 6 percent.

28. The kit for assembling a protective building structure as claimed in claim 25, wherein said lower assembly is rotatable relative to said base plate to achieve variable vertical positioning of said corresponding stanchion member relative to said sloping grade.

* * * * *

UNITED STATES PATENT AND TRADEMARK OFFICE

CERTIFICATE OF CORRECTION

PATENT NO. : 8,667,741 B1
APPLICATION NO. : 13/740884
DATED : March 11, 2014
INVENTOR(S) : Warner et al.

It is certified that error appears in the above-identified patent and that said Letters Patent is hereby corrected as shown below:

Title Page, Item (73) Assignee, line 1, "Dynamic Air Shelters Ltd." should read --Dynamic Shelters Inc.--.

Signed and Sealed this
Twenty-second Day of April, 2014

Michelle K. Lee

Michelle K. Lee
*Deputy Director of the United States Patent and Trademark Office*